US008344877B2

(12) United States Patent
Sheardown et al.

(10) Patent No.: US 8,344,877 B2
(45) **Date of Patent: *Jan. 1, 2013**

(54) TRACK WORKER SAFETY SYSTEM

(75) Inventors: Keith Burton Sheardown, Mississauga (CA); Sathya Vagheeswar Venkatasubramanian, Pittsburgh, PA (US); Jason John Freebern, Bolingbrook, IL (US)

(73) Assignee: Bombardier Transportation GmbH, Berlin (DE)

( * ) Notice: Subject to any disclaimer, the term of this patent is extended or adjusted under 35 U.S.C. 154(b) by 745 days.

This patent is subject to a terminal disclaimer.

(21) Appl. No.: 12/498,881

(22) Filed: Jul. 7, 2009

(65) Prior Publication Data

US 2011/0006912 A1 Jan. 13, 2011

(51) Int. Cl.
*G08B 1/08* (2006.01)

(52) U.S. Cl. ..... 340/539.13; 340/572.1; 340/539.23; 246/122 R; 246/124; 246/477

(58) Field of Classification Search ..... 340/539.1, 340/539.11, 539.13, 539.2, 539.23, 573.1, 340/572.1; 246/122 R, 124, 477
See application file for complete search history.

(56) References Cited

U.S. PATENT DOCUMENTS

| | | | | |
|---|---|---|---|---|
| 3,419,865 | A | 12/1968 | Chisholm | |
| 5,129,605 | A | 7/1992 | Burns et al. | |
| 5,727,758 | A * | 3/1998 | Penza et al. | 246/124 |
| 6,113,037 | A * | 9/2000 | Pace | 246/124 |
| 6,145,792 | A * | 11/2000 | Penza et al. | 246/167 A |
| 6,456,937 | B1 | 9/2002 | Doner et al. | |
| 6,609,049 | B1 | 8/2003 | Kane et al. | |
| 6,882,315 | B2 | 4/2005 | Richley et al. | |
| 7,624,952 | B1 * | 12/2009 | Bartek | 246/124 |
| 2004/0177032 | A1 | 9/2004 | Bradley et al. | |
| 2006/0151672 | A1 | 7/2006 | Heddebaut et al. | |
| 2007/0139191 | A1 | 6/2007 | Quatro | |
| 2008/0042912 | A1 | 2/2008 | Lee | |
| 2011/0278401 | A1 * | 11/2011 | Sheardown et al. | 246/167 A |

FOREIGN PATENT DOCUMENTS

| | | | |
|---|---|---|---|
| DE | 2619947 | A * | 11/1977 |
| JP | 10203368 | A * | 8/1998 |
| KR | 2010044339 | A * | 4/2010 |
| KR | 2011032276 | A * | 3/2011 |
| WO | 2007036940 | A2 | 4/2007 |

OTHER PUBLICATIONS

"The RFID Revolution Starts Now!," Multispectral Solutions, Inc., two pages, 2005.

* cited by examiner

*Primary Examiner* — Travis Hunnings
(74) *Attorney, Agent, or Firm* — The Webb Law Firm

(57) ABSTRACT

A safety system for providing early warning notifications to an authorized track worker performing official duties along a rail road network is disclosed herein. The safety system determines the position of the authorized worker and determines an estimated time to collision between the authorized track worker and an approaching rail vehicle. The result of the safety system is that the track worker has enough time and sufficiently accurate warning that will enable the track worker to move to a point of safety so as to remain unharmed by the approaching rail vehicle.

32 Claims, 18 Drawing Sheets

TRACK WORKER SAFETY SYSTEM

BACKGROUND OF THE INVENTION

Railroads are heavily regulated and rules governing track safety call for visual inspections of track integrity on a frequent basis. When this visual inspection is performed, track workers are put in harm's way as they are working close to the rails or on the rails in many cases and may not have adequate warning when trains are approaching. In addition, trains often approach at speeds greater than the posted speed limits and, therefore, little time is given to the worker to clear the track.

Over the years, many railway workers have lost their lives in accidents that occur on the nation's heavy rail and commuter rail systems. Many railway workers have also been seriously injured. While rail transit remains among the safest modes of transportation for passengers, there is a concern about the escalating number of incidents involving transit employees nationwide. Recently, the Federal Transit Administration (FTA) and Federal Railroad Administration (FRA) have uncovered data that shows a three-fold increase in the number of railway worker fatalities and a significant increase in injuries to railway workers. Each time a railway worker enters the job site, he or she is vulnerable to injury or death from a moving train.

Heretofore, there has been no automatic or systematic mechanism for the warning of workers near a railway. Failure to establish adequate work site clearance plans, failure to conduct adequate on-site track safety job briefings, failure of operators to follow speed restrictions, and failure of work crew leaders to remain alert at the site are all factors in this growing problem.

SUMMARY OF THE INVENTION

A safety system for providing early warning notifications to an authorized track worker performing official duties along a rail road network is disclosed herein. The safety system determines the position of the authorized worker and determines an estimated time to collision between the authorized track worker and an approaching rail vehicle. The result of the safety system is that the track worker has enough time and sufficiently accurate warning that will enable the track worker to move to a point of safety so as to remain unharmed by the approaching rail vehicle.

BRIEF DESCRIPTION OF THE DRAWINGS

The present invention can be easily understood and further advantages and uses thereof made readily apparent when considered in view of the description of the preferred embodiments and the following figures in which.

DESCRIPTION OF THE PREFERRED EMBODIMENTS

The present invention provides for a safety system that provides an early warning notification to a track worker about an approaching rail vehicle so that the track worker, following safe work practices, may move to a point of safety and prevent any bodily harm to oneself and to fellow track workers and their equipment. While the discussions below speak of rail vehicles, a person skilled in the art would easily be able to apply the safety system equally and effectively to other kinds of transportation systems and transit systems, such as automated roadway transportation systems, automated people mover (APM) systems, monorail systems, magnetic levitation (MAGLEV) transit systems, rubber-tired transit systems, and steel wheel-steel rail transit systems (including systems that include propulsion systems such as linear induction motors, hub motors, standard AC or DC propulsion systems, diesel systems, electric systems or hybrid systems).

While the present invention contemplates, in particular embodiments, the use of ultra wide band (UWB) RFID) based communication modes, it must be understood that in many existing rail network configurations, there may be instances where the network already has various systems to determine one or more of required collision parameters that are used to determine when a track worker needs to be notified. In such instances, the present invention may include the use of the existing system in lieu of the present invention disclosed herein or be included additionally for redundancy purposes.

Figure 1:
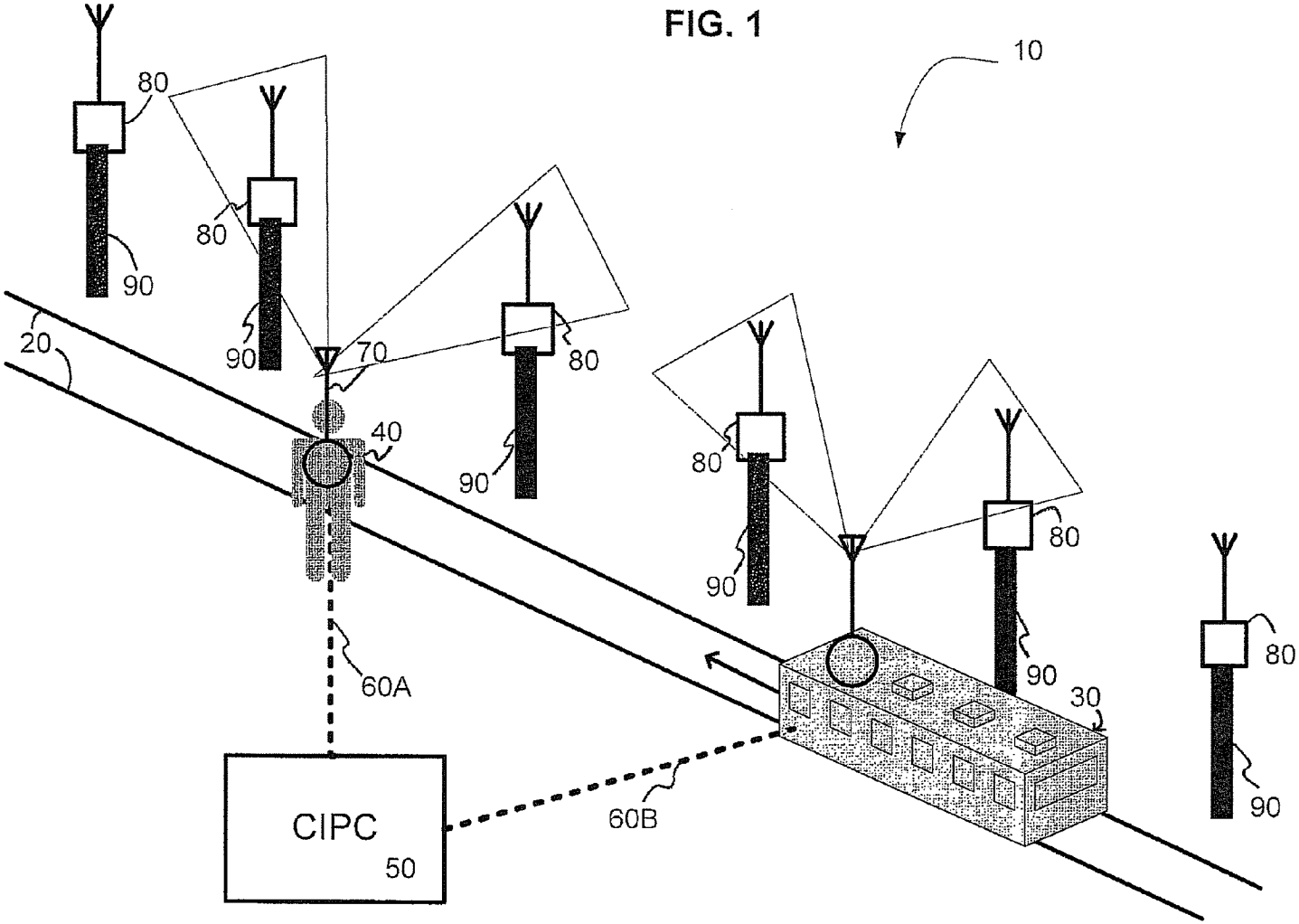
FIG. 1 is an illustration of one embodiment of the safety system as applied to a sample rail network comprising of at least one track worker along a rail road, a plurality of transceivers along the rail road, and an approaching rail vehicle.

Turning now to drawings and referring first to FIG. 1, the safety system 10 as applied to a sample rail network is illustrated. The rail network may include a railroad 20 with substantially parallel tracks, a rail vehicle 30 moving along the railroad 20 in a direction as shown, and a single track worker 40 moving along the railroad 20 to carry out routine maintenance or inspection activities. The safety system 10 includes a central information processing center 50 (hereinafter "CIPC") that is designed to receive information 60A, 60B that are indicative of position of the track worker 40 and the rail vehicle 30 respectively. Additionally, this information 60A, 60B may include other information that is included and/or required by the safety system 10. This information, as we will see in later sections, may be obtained in a variety of ways. The lines representing 60A and 60B are merely representing the fact that the information 60A and 60B are derived from the track worker 40 and rail vehicle 30 respectively and do not constitute a direct physical connection from either the track worker 40 or the rail vehicle 30 to the CIPC 50.

To elaborate further, information 60A and 60B may include information that are indicative of one or more of position, speed and direction of motion of the track worker and rail vehicle 30 respectively.

Consider the track worker 40 entering a work area (not shown), defined as a section or segment of the railroad 20 where a routine maintenance activity needs to be carried out. The track worker 40 wears on his/her person a device 70 that is capable of transmitting signals that may constitute part or entirely of track worker information 60A. Information may be stored on the device 70 either permanently or on a temporary basis. This information 60A will then be relayed to the CIPC 50 using communication modes that will be described in later sections. In certain implementations, the device 70 includes an active RFID tag (not currently shown) that by definition has its own power source, such as a battery. This power source may be built into the tag 80, or the device 70 or be located outside the device for powering the tag 80. The active RFID tag may also include any other form of power supply known in the art. In the sections that follow, we will describe the device 70 as transmitting RFID signals even though it is actually the RFID tag within the device 70 that actually transmits the RFID signals. In some implementations, the device 70 may transmit signals as ultra wide band (hereinafter "UWB") RFID pulses. Unlike conventional RFID systems, which operate on single bands of the radio spectrum, UWB RFID transmits signals over multiple bands of frequencies simultaneously, from 3.1 GHz to 10.6 GHz. UWB signals are also transmitted for a much shorter duration than those used in conventional RFID. UWB tags consume less power than conventional RF tags and can operate across a broad area of the radio spectrum, UWB be used in close proximity to other RF signals without causing or suffering from interference because of the differences in signal types and radio spectrum used. The advantages of using UWB RFID may include a longer range of tag interrogation, greater immunity to signal degradation, higher degree of security and immunity to eavesdropping, greater uniform coverage over a given area, and greater potential for anti-collision in a multi-tag environment. The present invention envisions the device 70 to be read at distances of up to 1000 meters.

Additionally, in an alternate embodiment, the device 70 may also be configured to receive notifications from the CIPC 50, such as when a safety warning notification is sent by the safety system 10 through the CIPC 50 that will alert the track worker 40 to move to a point of safety.

The CIPC 50 includes information receiving modules, information processing modules, information storing modules, and information relaying modules. These modules, for example, may be housed within a single device or be distributed across a network in multiple devices. The CIPC 50 will be explained in later sections. In some implementations, the CIPC 50 may also interface with an external data back-up module for storing all activities pertaining to the safety system, including provisions for continuously storing the last 30 or 45 minutes of activity of the safety system for forensic analysis when required. The duration of storage may be altered by the safety system administrator as required. It must be also noted that the architecture of the CIPC 50 may ultimately depend on the nature of the software architecture and platform that is going to drive the safety system 10, establish the exchange of information between the various components of the safety system 10, including processing and initiation of appropriate warnings to the track worker 40 when required.

Continuing with our discussion of FIG. 1, in one instance, the CIPC 50 by default uses a preset critical time. Critical time may be defined as the minimum time that is required by the track worker 40 to safely clear out of the way of an approaching rail vehicle in order to avoid harm to oneself, fellow track workers and/or any equipment. Critical time may depend on various factors such as age of the track worker, health of the track worker, nature of work performed by the track worker, maintenance equipment present and used by the track worker, weather, among other factors. In certain implementations, the track worker 40 is able to override the preset critical time by providing a desired critical time to the CIPC 50. In such instances, the desired critical time may be provided prior to entering a work area or dynamically provided while on the railroad 20. While it is important for the track worker to provide a preferred critical time, the safety system 10 considers the possibility that the track worker may sometimes fail to provide this information prior to start of work and hence includes the preset critical time. The preset critical time can also be changed as per the safety requirements of the operator and/or the rail network safety system administrator. In certain embodiments, when the track worker 40 enters a desired critical time that is less than the preset critical time, the safety system 10 ensures that the track worker 40 re-confirms the change. The CIPC 50 uses either the preset critical time or the desired critical time, but not both. In the following sections, when critical time is discussed, it should be realized that it can mean either the preset critical time or the desired critical time.

Additionally, the safety system 10 may also include a provision where the track worker 40 cannot provide the critical time to be greater than a certain maximum value. This maximum value may be preset for the system, but may be changeable for any particular scenario. This ensures that the safety system 10 is not functioning to provide a distraction to the track worker 40 when safety is not in doubt. For example, when the track worker 40 provides the critical time to be 2 hours, the safety system 10 may indicate that the system cannot provide a warning for a dangerous situation that is 2 hours from occurring. The safety system 10 may indicate that the system is not enabled to provide, for example, more than a 45 minute warning to the track worker 40. In a similar manner, the safety system 10 also includes a provision where the critical time cannot be lower than a preset minimum critical time value for safety purposes. Another reason to limit the amount of warning time to the track worker is that giving too long a duration between notification and possible occurrence of a safety related incident (if the notification is not heeded) may result in the track worker acknowledging the notification and continuing to work simply because there is more time for the probable incident to occur. This may only serve to increase the risk of an incident rather than mitigating it. It should be realized that the safety system 10 allows for the preset, preferred, minimum and maximum values of critical time to be configurable.

In accordance with another aspect of the invention, the CIPC 50 may replace critical time with a critical distance value to determine when to send a safety alert notification to the track worker. Critical distance may be defined as the minimum distance of separation between the track worker and the approaching rail vehicle so that the track worker may safety clear the path of the rail vehicle. Analogous to the discussion of critical time, the critical distance may also be provided to the safety system 10, and thereby to the CIPC 50 as either a preset critical distance or a desired critical distance. Similar to the discussion about the critical time, the safety system 10 in an embodiment may include a provision where the track worker 40 cannot provide the critical distance more than a preset maximum value or lower than a preset minimum value for safety purposes.

In an exemplary embodiment of the present technique, the rail network 15 includes one or more rail vehicles, such as rail vehicle 30 that moves along the rail road 20. The CIPC 50 is further adapted to receive rail vehicle information 60B indicative of the rail vehicle's position, speed, and direction of motion along the rail road 20. Additionally, the rail vehicle information 60B may include other information that defines the state of the rail vehicle.

The safety system 10 further includes a plurality of transceivers 80. Transceivers, by definition, have the ability to send and receive information. In an alternate embodiment, the transceivers 80 may be replaced by a separate receiver (not shown) and transmitter (not shown) units that together achieve the functional capability of the transceivers. The transceivers 80, in the present embodiment, are capable of receiving information from the device 70 about the track worker 40 and also relaying the information to the CIPC 50. The transceivers 80 are further configured to receive rail vehicle information 60B from the rail vehicle 30. The transceivers 80 may include, for example, RFID readers that are adapted to receive the signals from the device 70. The transceivers 80 may be mounted on elevated structures such as, for example, towers 90 that are situated on the wayside. Wayside may be defined as the area on either side of the railroad 20 that is available for use to situate any equipment that may be considered as part of the rail network 15 and/or the safety system 10. It should be apparent to the person skilled in the art that there may be other equipment located on the wayside, such as signaling equipment, power distribution equipment and various support structures. In certain implementations, the towers 90 may be replaced by other kinds of support structures including, for example, a building, or any structure to which the transceivers 80 may be affixed. In certain implementations, the transceivers 80 may be located on top of catenary support structures that are an integral part of an electrified track network.

The transceivers may, in certain implementations, also be directionally oriented. In other words, the transceivers may be adapted to only read in a direction substantially around the region of the rail road 20. This means that a track worker 40 resting in a safe, designated area outside of the rail road 20 but within the vicinity of the transceiver 80 may not be notified.

The transceivers 80 are spaced at distances such that the device 70 would be read by at least one transceiver 80. However, in the present embodiment, the transceivers 80 are positioned such that their operating ranges overlap with adjacent transceivers 80 on either side for redundancy purposes. This means, each transceiver 80 is read by another transceiver 80 on either side. This overlapping feature ensures that there are no dead zones between two RFID readers where the RFID tag 70 is not read. This feature is particularly useful in some embodiments of the safety system 100 (to be discussed later). Therefore, in the present embodiment, the device 70 may be read by at least two transceivers 80.

Figure 2:
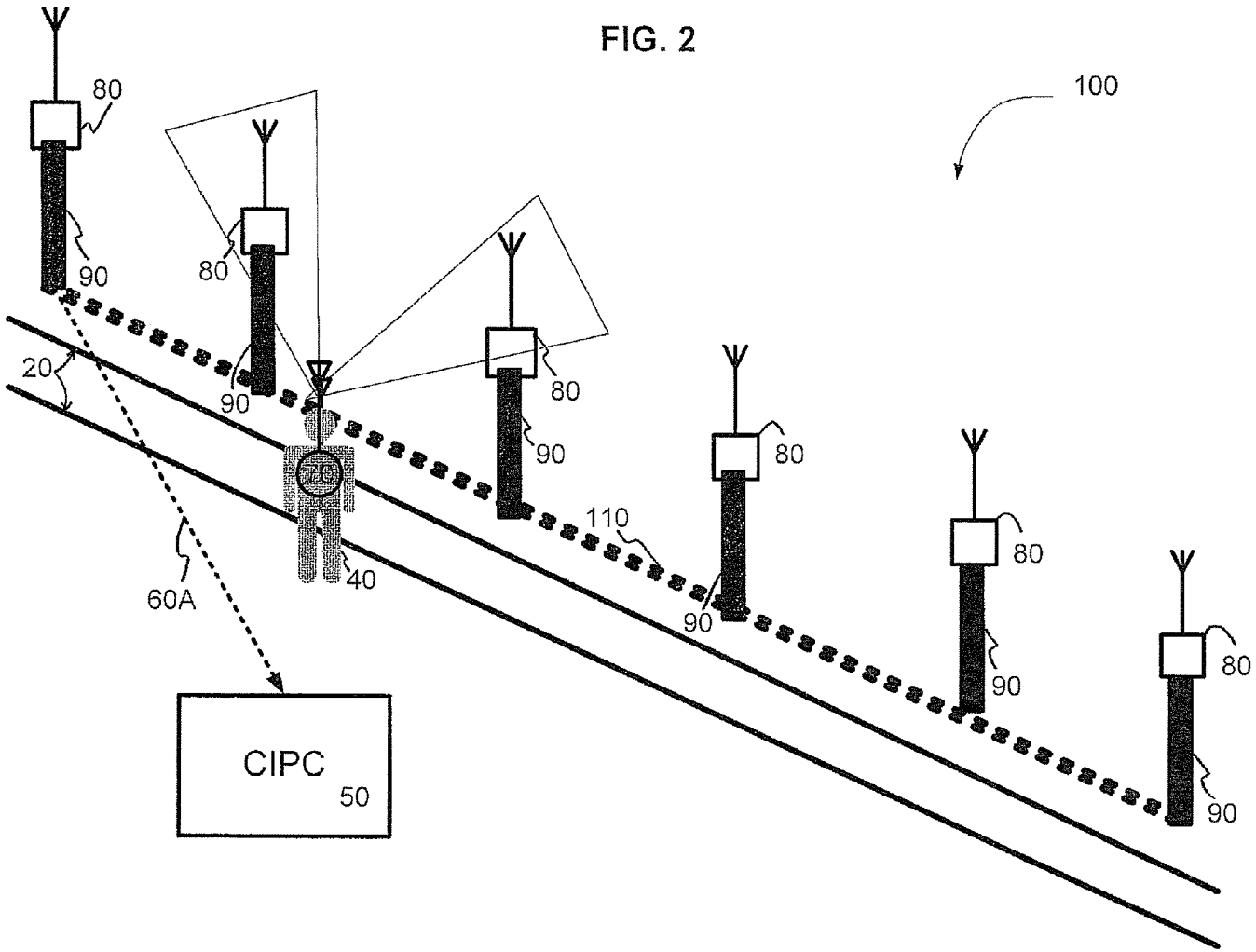
FIG. 2 is an illustration of one embodiment of the safety system comprising a plurality of transceivers networked via a wired communications network backbone (CNB)

In accordance with one embodiment 100, such as illustrated by FIG. 2, the transceivers 80 may each be wired to a communication network backbone 110 (hereinafter "CNB"). The CNB 110 may be an Ethernet type, Optic Fiber type or any other network backbone known in the art. When the device 70 is detected by the transceiver 80, information from the device 70 is being transmitted to the transceiver 80. Information typically includes an identification of the track worker 40 along with other relevant information such as demographic and/or personal information. The information from the device 70 are then tagged with information about the transceivers 80 (that are reading the device 70) prior to being sent as the track worker information 60A to the CIPC 50. Information about the transceivers 80 may typically include their position location and coordinates, strength of the received signal from the device 70 and/or their time of arrival (TOA) at the respective transceiver 80. It must be further realized that a signal sent by the device 70 in the present context is defined as an entity that may contain part of or all information contained within the device. The signal may be encrypted or unencrypted and should not be considered as a limiting factor. In another embodiment, the information from the device 70 may correspond to a predetermined entry in a database accessed by the CIPC 50. Using databases (may include a relational database), broad descriptions of the device 70 can be stored when the device 70 is assigned to a worker. It must be realized at this point that the device and its associated RFD tag may only have limited memory capacity. This may, sometimes, not be sufficient to include all the necessary information. In such a scenario, a relational database configuration may be used to map any data contained within the device 70 to a broader set of data (which is actually the usable information for the CIPC 50).

In one embodiment as illustrated in FIG. 2, it is possible that more than one transceiver 80 receives signals sent by the device 70. When multiple transceivers, in this case two, are receiving information from the device 70, various techniques as known to those skilled in the art are used to determine to which transceiver the track worker 40 is closer to and to which transceiver the track worker 40 is farther from. This determination is made by the CIPC 50 which two sets of data streams from each of the transceivers. Each of the data stream will include any relevant information from the device 70 along with information about that particular transceiver. This can include the time of arrival of information from the device 70 to that particular transceiver, strength of the received signal that contains the information from the device 70 etc.

In one example, the CIPC 50 may use the time of arrival (TOA) of signals at either of any two transceivers 80 to determine proximity. In such a case, the transceivers 80 may also include a synchronized clock. From this information, the CIPC 50 can determine the speed and the direction of movement of the track worker 40.

In another example, the CIPC 50 may use the relative strength of signals received by at least two transceivers to determine to which transceiver the track worker is closer to. By continuous monitoring of the relative signal strengths and determinations of proximity, the CIPC 50 may determine the direction and also the speed of movement of the track worker 40.

Comparing the description for FIG. 1 and FIG. 2, it can be easily understood that what was described as track worker information 60A is combination of information about the track worker and the information about the transceivers as discussed in FIG. 2.

It should further be noted that the distance of separation between transceivers 80 may be variable, and is not meant to be a limiting feature of the present invention. As will be explained, uniform spacing is not required in a linear system. Similarly, uniform spacing is not also required for a staggered or trilateration type of arrangement. With railway safety systems as disclosed herein, obstructions can arise causing a need to place the transceivers closer. For example, in tunnels having sharp turns, close placement of transceivers gives precision readings without obstruction by tunnel walls. In certain cases, the presence of an obstruction free environment may facilitate larger separation between the transceivers 80. Therefore it is also common to find implementations where the plurality of transceivers is spaced apart at variable distances.

It will also be apparent that the CIPC 50 will have to tap into the CNB 110 in order to receive any information. In networks that are small to medium size, such as for a track network of length, say up to 10 km long, the CIPC 50 may be located at about a central location on the track network. For larger networks, say, over 10 km long the CIPC 50 may be in the form of a distributed network comprising a plurality of processing centers that together are configured to receive and process and transmit any data and information along the entire track network. Again, the use of either a CIPC or a distributed information processing center (DIPC) should be a choice that is not limiting to the implementation of the safety system 10. The choice of CIPC or DIPC implementation will depend on a variety of factors including availability of resources, and customer preference. It will also be apparent that the communication between the CIPC 50 and the track worker cannot be delayed due to network latency. Therefore, any known techniques to augment or improve the network communication bandwidth, including a faster communication protocol may be employed to facilitate a timely notification to the track worker.

The transceivers 80 can be directly coupled to the CNB 110. The transceivers 80 may include a wired or wireless router, and/or any other device configured to provide access to the safety network 10. The connection of the transceivers to the CNB 110 can be via any type of mechanical, optical, electrical or electronic type known in the art. In some implementations, the safety network 10 may include a leaky cable or a radiating cable that is operative to receive wireless signals (in our case, RFID signals) from the transceivers 80. Alternatively, the safety network 10 can be a network cable and one of the transceivers 80 may be directly coupled and configured to act as a forwarding device of safety network 10 to couple other devices, including other transceivers to the safety network 10. In either alternative, the safety network 10 can be accessed wherever a transceiver 80 is located.

In an alternate embodiment, it is also possible to have some of the transceivers communicate wirelessly while some of the transceivers communicate through a wired network. The choice of which communication modes to be used and/or what portions of either mode are to be used depend on the particular implementation of the safety system and the operating environment.

In another embodiment of transceiver configuration, a second transceiver 80 does not have a direct wired connection to the safety system 10 via the CNB 110. Such transceivers may interface to the CNB 110 through at least one other transceiver 80 that is connected to the CNB 110. This configuration allows multiple transceivers to interface and communicate to the safety network 10 without requiring installation of direct wired connections to safety network 10. This may be facilitated through wired or wireless connections between transceivers. The transceivers 80 relay the tag ID signal along a transceiver ID signal to the CIPC 50.

Forwarding information based on network layer information is often referred to as routing. Forwarding information based on data link layer information is bridging or switching. Data can be sent to the safety network 10 in any fashion, including routing, switching, or bridging. One network layer forwarding technique is to use serial ports of the transceivers 80 to create IP tunneling using data encapsulation techniques. In such a fashion, a TCP datagram can be passed over serially connected transceivers and onto a network. It is also possible that an alternative, non IP, communication system known in the art is employed, which would require further description; as is the case with one provider of location awareness technology when their receivers are connected by wire.

In accordance with another embodiment, only one transceiver 80 may receive signals from the device 70. In such a case, relative signal strength may not be determinable. The CIPC 50, in this case, uses the position of the transceiver 80 that received the signal from device 70 to determine the position of the track worker 40. In this embodiment, the determination of the position of the track worker 40 is going to be virtual and based on direction of an approaching rail vehicle (not shown). Each transceiver 80 has a certain range of coverage on either side of the rail road 20, and based on the direction of approach of a rail vehicle, the CIPC 50 determines the closest possible distance from the rail vehicle to the edge of its coverage area. The information about coverage area may be available in a central database accessed by the CIPC 50.

Figure 3:
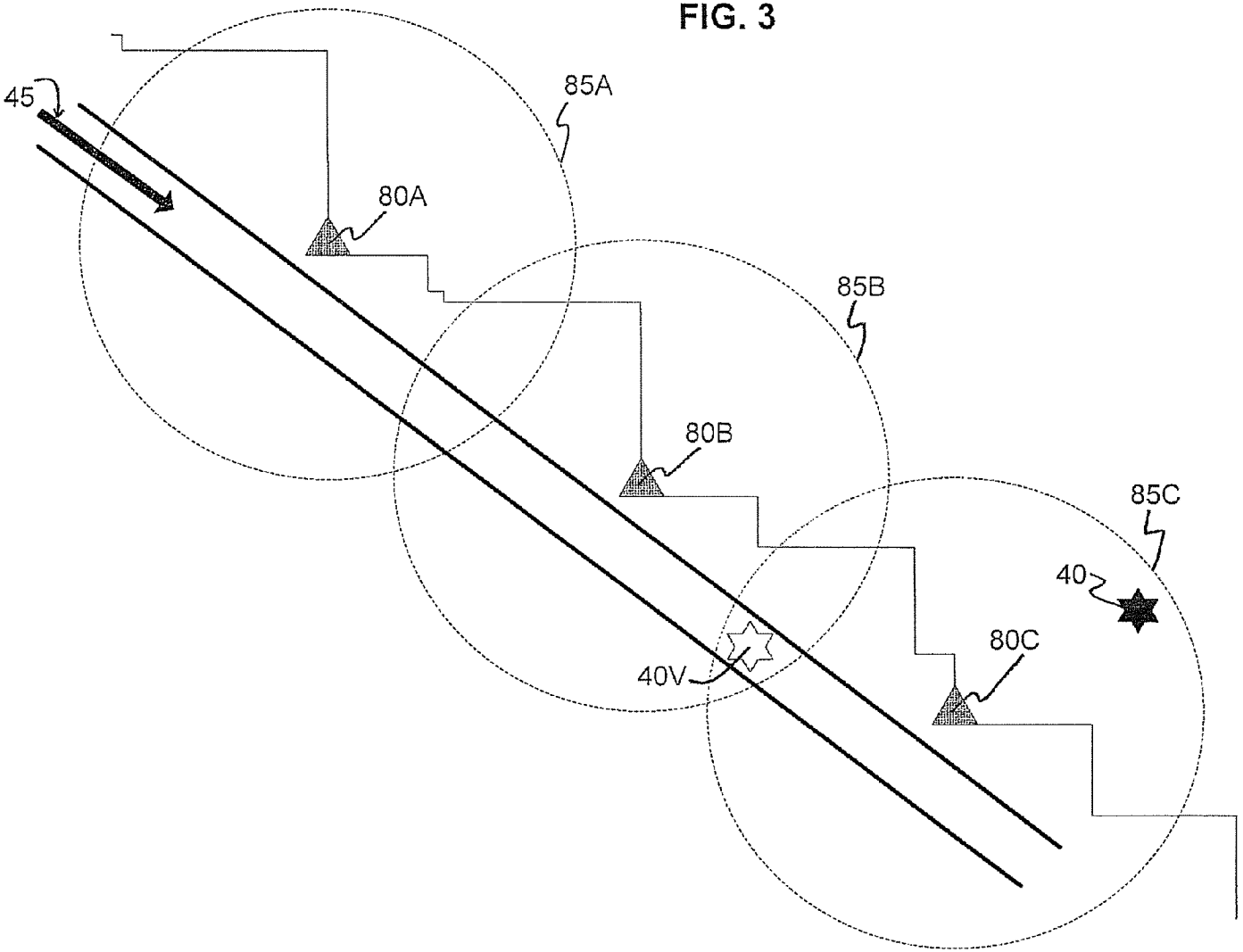
FIG. 3 is an illustration of another embodiment of the safety system of FIG. 2 showing the determination of virtual track worker position.

Consider FIG. 3 for example. The figure illustrates a track worker 40 moving along a rail road 20 having three transceivers 80A, 80B and 80C connected to the CNB 110. At present the track worker is within the range of transceiver 80C. This means that the transceiver 80C can interrogate the device 70 on the track worker 40. The regions of coverage for each of the transceivers 80A, 80B and 80C are indicated by 85A, 85B and 85C respectively. The direction of travel of an approaching rail vehicle (not shown) is represented by arrow 45. When the CIPC 50 determines that track worker 40 is within the coverage area of the transceiver 80C, it then determines a virtual position 40V of the track worker regardless of where the track worker is actually in the vicinity of the transceiver 80C. The CIPC 50 then uses the virtual position 40V of the track worker 40 to determine if the track worker should be notified of the approaching vehicle. It can have a cost benefit solely out of this feature. Preferably, this embodiment may be employed in cases where all the transceivers in the safety system 10 are wired to the CNB 110. In cases where all the transceivers 80 in the safety system 10 communicate wirelessly with each other, such an arrangement may not be entirely feasible.

In a certain embodiment (not illustrated), the track worker 40 may be recognized by more than one transceiver, say both 80B and 80C. In that case, the CIPC 50 will again determine the virtual position 40V of the track worker 40 as the one that gives the closest distance to the approaching rail vehicle. Obviously, for the purposes of this embodiment, it is assumed that the CIPC 50 has information pertaining to position of the rail vehicle 30. One advantage of having only one transceiver available in a region to detect a track worker is that it allows for spacing out of the transceivers on the rail network 15.

Figure 4:
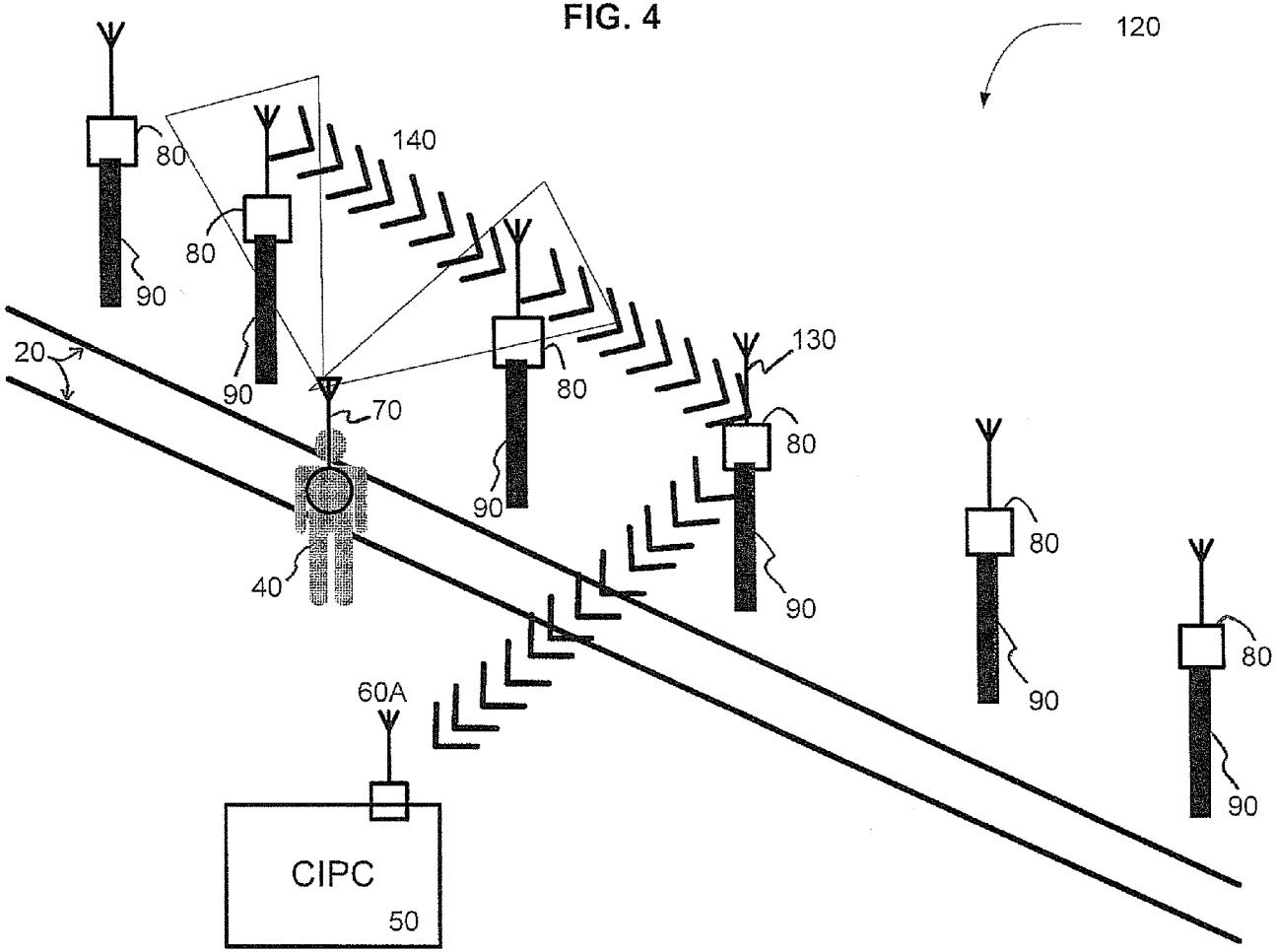
FIG. 4 is an illustration of another embodiment of the safety system wherein the plurality of transceivers are networked via a wireless CNB.

In accordance with another aspect of the safety system 120 as illustrated in FIG. 4, the communication between the track worker 40, the transceivers 80 and the CIPC 50 may also be wireless, using a communication mode such as WIMAX or ZIGBEE. In the present embodiment, there is no CNB 110 as previously seen in the embodiment of FIG. 2. Instead, the communication is wireless. In the present embodiment, the CIPC 50 has at least one transceiver 80 that is denoted as its master node 130. In the case of ZIGBEE networks, the master node is also referred to as the 'gateway'. Every other transceiver 80 will communicate towards the master node 130 and the master node will further communicate all information to the CIPC 50. In the case of a WiMAX type of network architecture, a plurality of WiMAX Access Points (AP) is distributed along the right of way at spacing of up to 5 kilometers. No one AP is considered more significant than the other. The CIPC or DIPC would be within range of at least two APs so that redundancy is provided in the network. As seen, the track worker 40 is detected by two transceivers 80A and 80B. Similar to the previous embodiment, information from the device 70, and information from each of the transceivers 80 that receive the information from the device 70 is then sent via wireless signals 140 to the master node 130 and then on to the CIPC 50. In other words, the transceiver 80A will relay the information it received from the device 70 along with its own specific information (as discussed previously) to the transceiver 80B. In the meantime, transceiver 80B may or may not have forwarded its own information (includes information it received from the device 70 along with its specific information) to the master node 130. The transceiver 80B forwards the information relayed from transceiver 80B to the master node 130. In this manner, all information is wirelessly relayed to the CIPC 50. In an alternate embodiment (not shown), the connection between the master node 130 and the CIPC 50 may also be wired (electrical or optical). It will also be apparent from later sections that the direction of communication, though currently seen as being unidirectional, may be bidirectional in certain embodiments (not currently shown).

The above sections described the system from the standpoint of the track worker 40. The following sections will describe the system from the standpoint of the rail vehicle 30.

Figure 5:
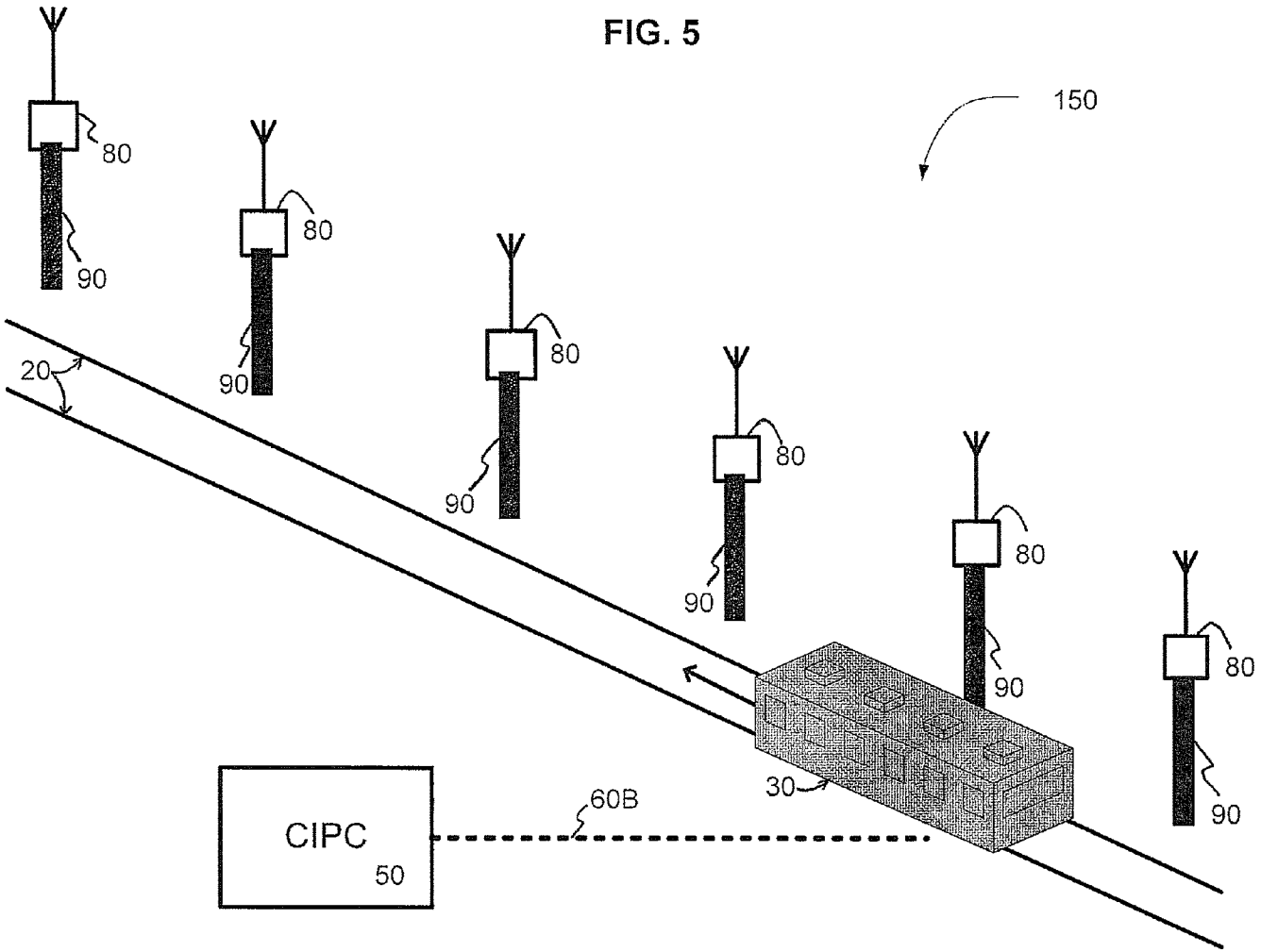
FIG. 5 is an illustration of interaction between the safety system and the rail vehicle.

Consider the rail network 150A as shown in FIG. 5. The rail vehicle 30 is moving along the railroad 20 in a direction as shown. The CIPC 50 receives information 60B which is indicative of the position, speed, and direction of movement of the rail vehicle 30. This information 60B can be obtained or determined in various ways as described herein below.

Figure 6:
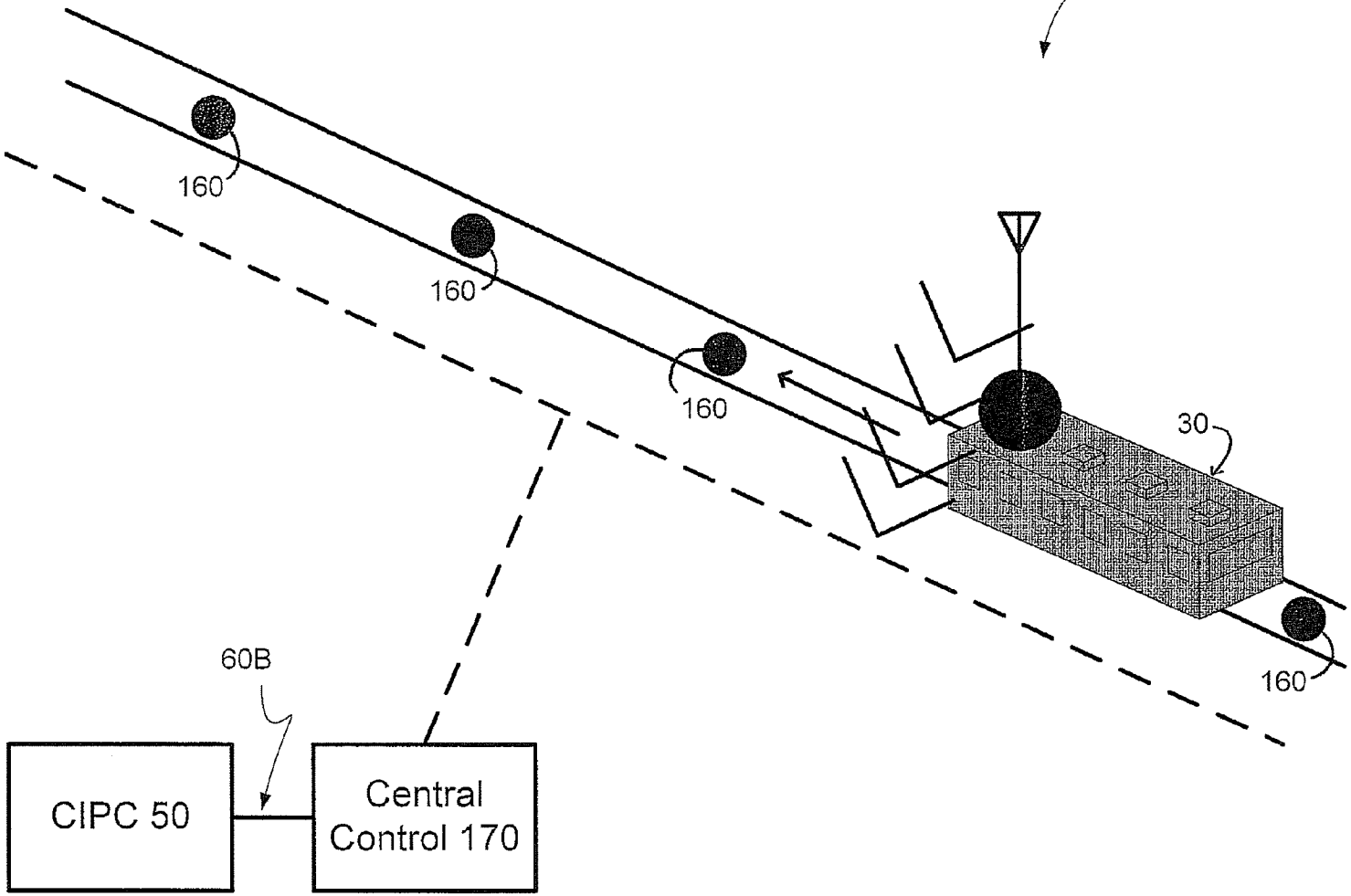
FIG. 6 is an illustration of wireless communication between the rail vehicle and the wayside using a leaky cable.
Figure 7:
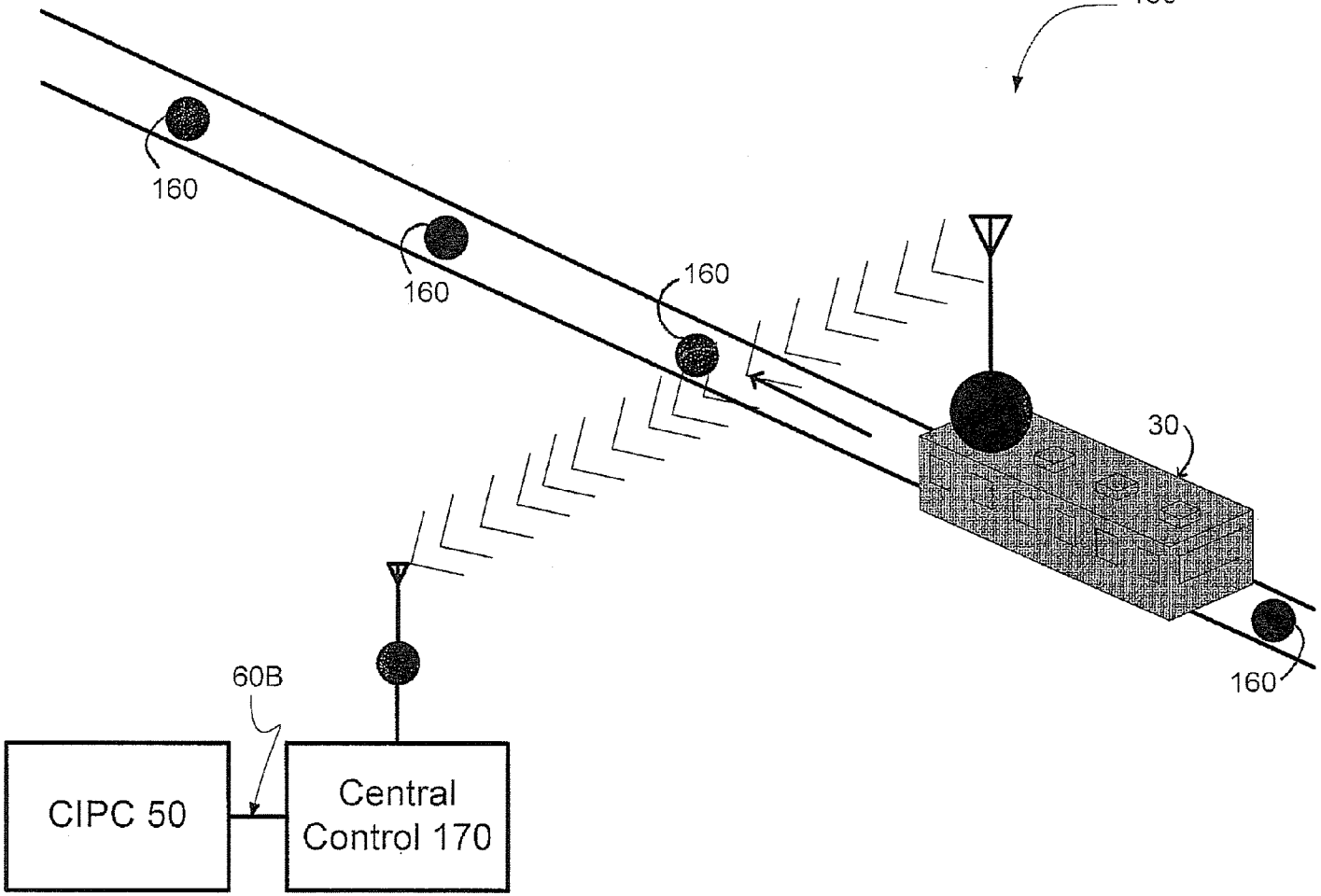
FIG. 7 is an illustration of wireless communication between the rail vehicle and central control.

In accordance with one embodiment, as illustrated in FIG. 6, the rail network 150B includes an RFID tag-reader system that includes RFID tags 160 embedded on the rail road 20, and RFID readers (not shown) attached to the underbody of the rail vehicle 30. The RFID tags 160, for the purpose of reducing maintenance costs, are passive tags which energize only when interrogated (in RFID parlance) by the RFID reader. Passive tags, by definition, do not include a power source. The passive tags are powered by RFID pulses received from an RFID reader, a process referred to as 'interrogation'. Once energized, the passive tags then transmit any information contained back to the RFID reader. Once the RFID reader moves out of range of the RFID tags, the tags get de-energized. The RFID tags 160, in the present embodiment, may contain accurate position information of the tags and when the rail vehicle 30 and its RFID reader passes over the RFID tag 160, the position information is transferred to the RFID reader and the rail vehicle's position is assumed to be the position of the RFID tag at that instant. In certain other implementations, the rail vehicle 30 has its own positional reference system and uses the RFID tag-reader system to simply recalibrate or remove any accumulated errors that build up when the rail vehicle 30 travels. This information is typically sent from the rail vehicle 30 via wireless to a wayside receiving system, such as a leaky cable 180 (example: Radiax brand cable) as shown in FIG. 6 or a Wireless Receiver 190 as shown in FIG. 7 that further communicates the information to the central control 170 which is an integral part of any rail network. The central control 170 is used by the train operator as a control and command center that is used to initiate any activity in the rail vehicle 30. For automated transit systems, there are systems called the Region Automatic Train Operation (RATO) and the Region Automatic Train Protection (RATP). The RATO ensures proper train operation whereas the RATP ensures proper train protection. Like for any safety system, the RATO and the RATP may have multiple redundancies. The safety system 10 when deployed in an automated transit system environment will require the CIPC 50 to communicate with both the RATO and RATP systems. The RATP and the RATO together form the Region Automated Train Control (RATC). Similarly, each of the trains running within the automated transit system will have its own Vehicle Automated Train Control (VATC) comprising of the Vehicle ATO (VATO) and Vehicle ATP (VATP) responsible for ensuring proper vehicle operation and vehicle protection. Similar to their region counterparts, the VATP and VATO may have multiple redundancies. The CIPC 50 may further communicate with either the RATC or the VATC. In mainline transit applications, the central control 170 may be used to control switching of the rail vehicle from one path to another, and controlling the movement of multiple rail vehicles in a safe and efficient manner. In the present embodiment, the central control 170 may be pre-configured to receive this information and the CIPC 50 may simply extract that information from the central control 170 for use by the safety system.

In the present embodiment of the safety system, the CIPC 50 obtains the rail vehicle information 60B from the central control 170 and uses the information 60B along with information 60A (determined earlier, and not shown in FIG. 7) in order to determine the time to possible collision between the rail vehicle 30 and the track worker 40.

The use of the leaky cable (in FIG. 6) may be for both sending and receiving wireless signals from the rail vehicle 30. The leaky cable 180 may be operated on a simplex or a duplex mode.

Figure 8:
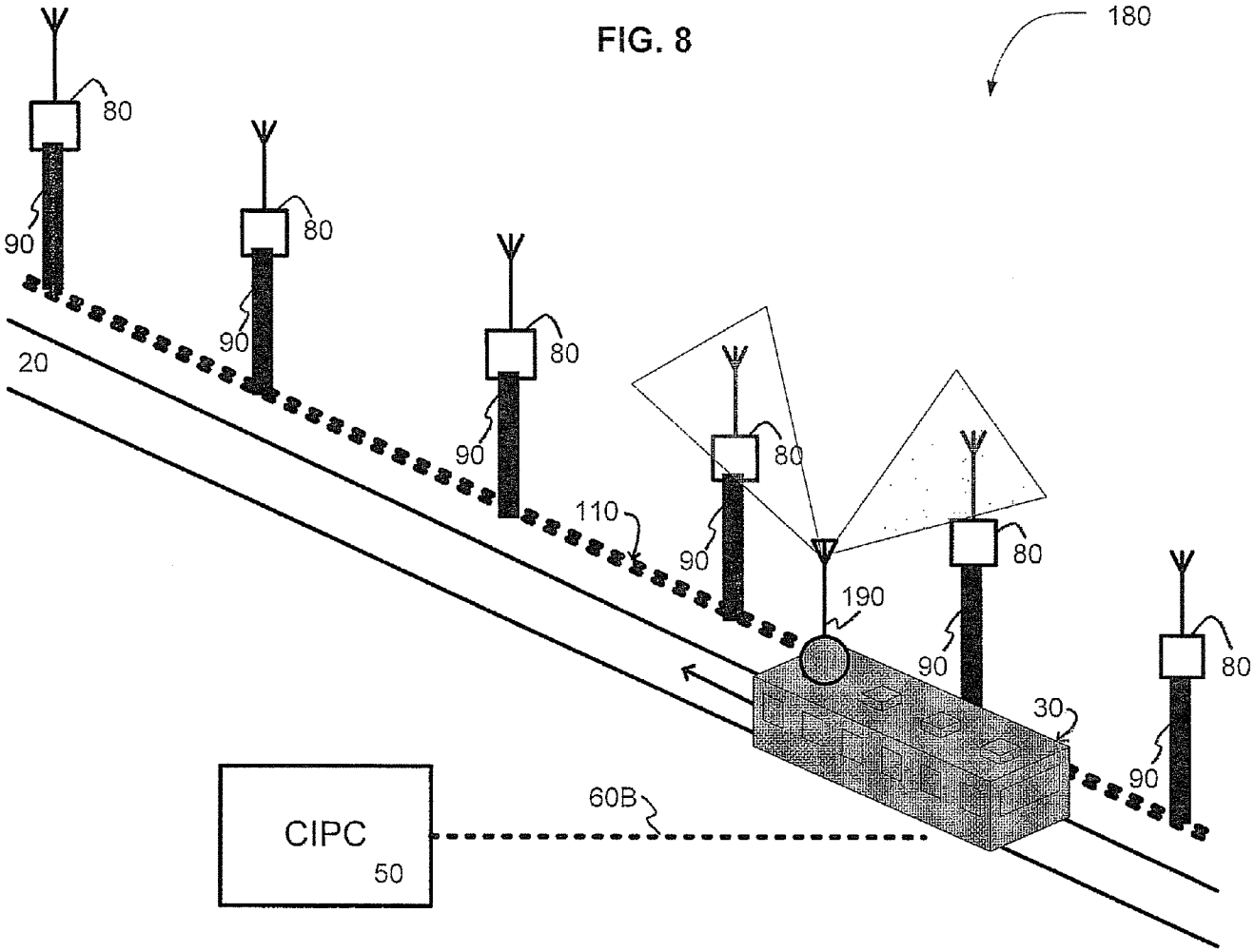
FIG. 8 is an illustration of communication between the rail vehicle and the plurality of transceivers, wherein the transceivers are networked via a wired CNB.

In accordance with one embodiment such as illustrated by FIG. 8, the safety system 150C includes an arrangement that is similar to the embodiment described earlier and illustrated in FIG. 2 as far as the wayside infrastructure is concerned, the transceivers 80 may each be wired to the CNB 110. The CNB 110 may be an Ethernet type or an optic fiber type. The rail vehicle 30 includes an active RFID tag 190 which is constantly powered (such as when the tag is an active tag). When signals from the RFID tag 190 are detected by at least one transceiver 80, information from the tag 190 is being transmitted to the transceiver 80. Information typically includes an identification of the rail vehicle 30, along with other relevant information about the rail vehicle such as its destination, its route plan, security information etc. The information from the tag 190 are then coupled with information about the transceivers 80 from which the signals are read and further sent as indicative of the rail vehicle information 60B. Information about the transceivers 80 may typically include their position location, strength of the received information from the device 70 and/or their time of arrival (TOA) at the respective transceiver 80. In other embodiments, the information from the RFID tag 190 may correspond to a predetermined entry in a database at the CIPC 50. Using relational databases, broad descriptions of the subject associated to the RFID tag 190 can be stored when the RFID tag 190 is assigned to a rail vehicle 30.

Figure 9:
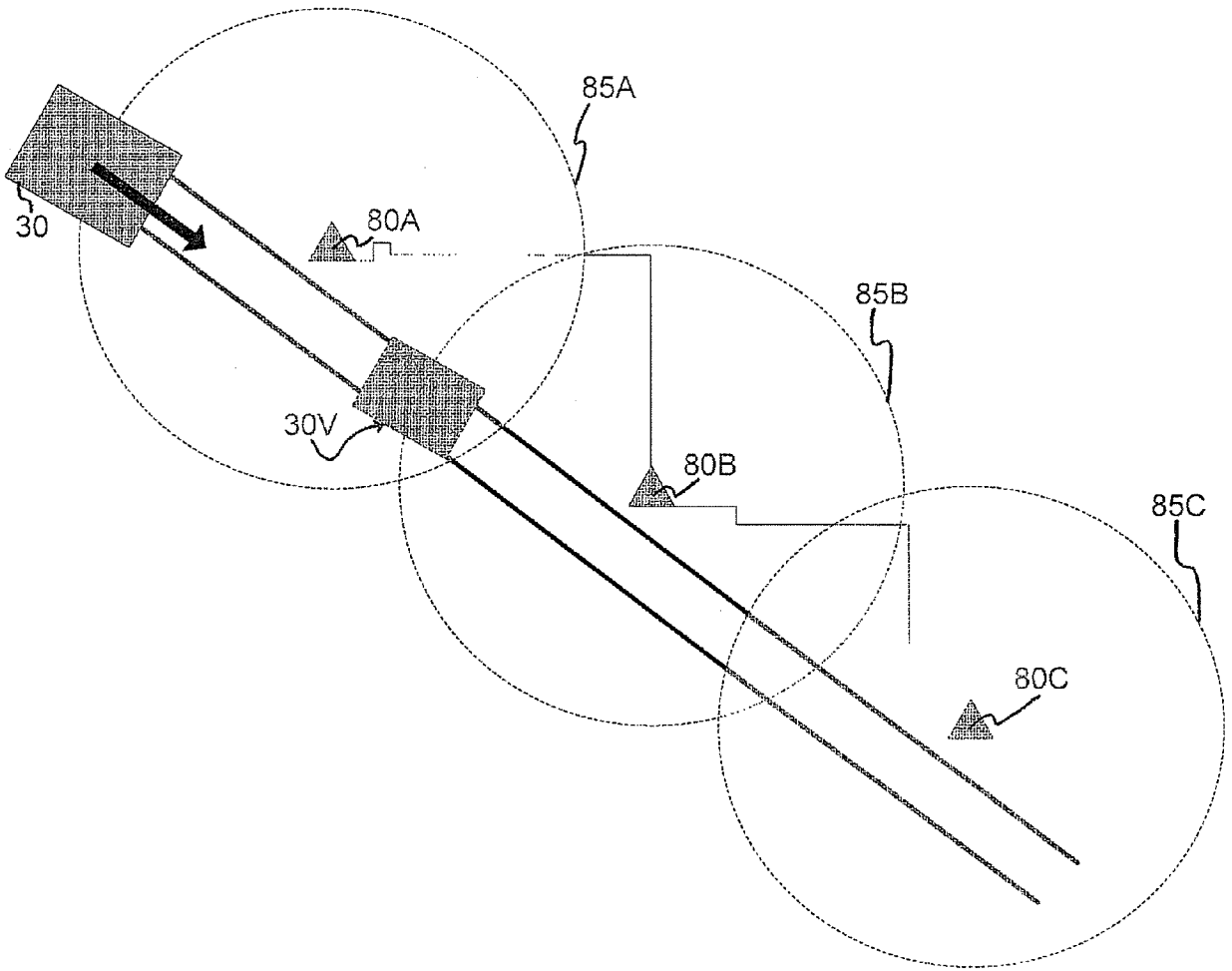
FIG. 9 is an illustration of another embodiment of FIG. 8 showing the determination of virtual rail vehicle position.

In accordance with another embodiment of the safety system as illustrated in FIG. 9, the CIPC may use the same principles (as explained previously in connection with FIG. 3) to determine the virtual position of the rail vehicle 30. While the safety system 10 provides provisions for virtual determination of rail vehicle position, it should be assumed that the rail network will have inherent capabilities to accurately or approximately determine the position of any or all rail vehicles in the rail network.

It is possible, by design, that more than one transceiver 80 receives signals sent by the RFID tag 190. When multiple transceivers, in this case two, are receiving information from the RFID tag 190, various techniques as known to those skilled in the art are used to determine to which transceiver the RFID tag 185 is closer to and to which transceiver the RFID tag 190 is farther from (and thereby, that of the rail vehicle 30). This determination is made by the CIPC (not currently shown) which receives all the relevant rail vehicle information 60B, which in our present embodiment includes information from the RFID tag 190, and information about the transceivers 80 as discussed previously.

In one example, the CIPC 50 may use the time of arrival (TOA) of signals at either of any two transceivers 80 to determine proximity. In such a case, the transceivers 80 may also include a synchronized clock. From this information, the CIPC 50 can determine the speed and the direction of movement of the rail vehicle 30.

In another example, the CIPC 50 may use the relative strength of signals received by at least two transceivers to determine to which transceiver the rail vehicle 30 is closer to. By continuous monitoring of the relative signal strengths and determinations of proximity, the CIPC 50 may determine the direction and also the speed of movement of the rail vehicle 30.

Figure 10:
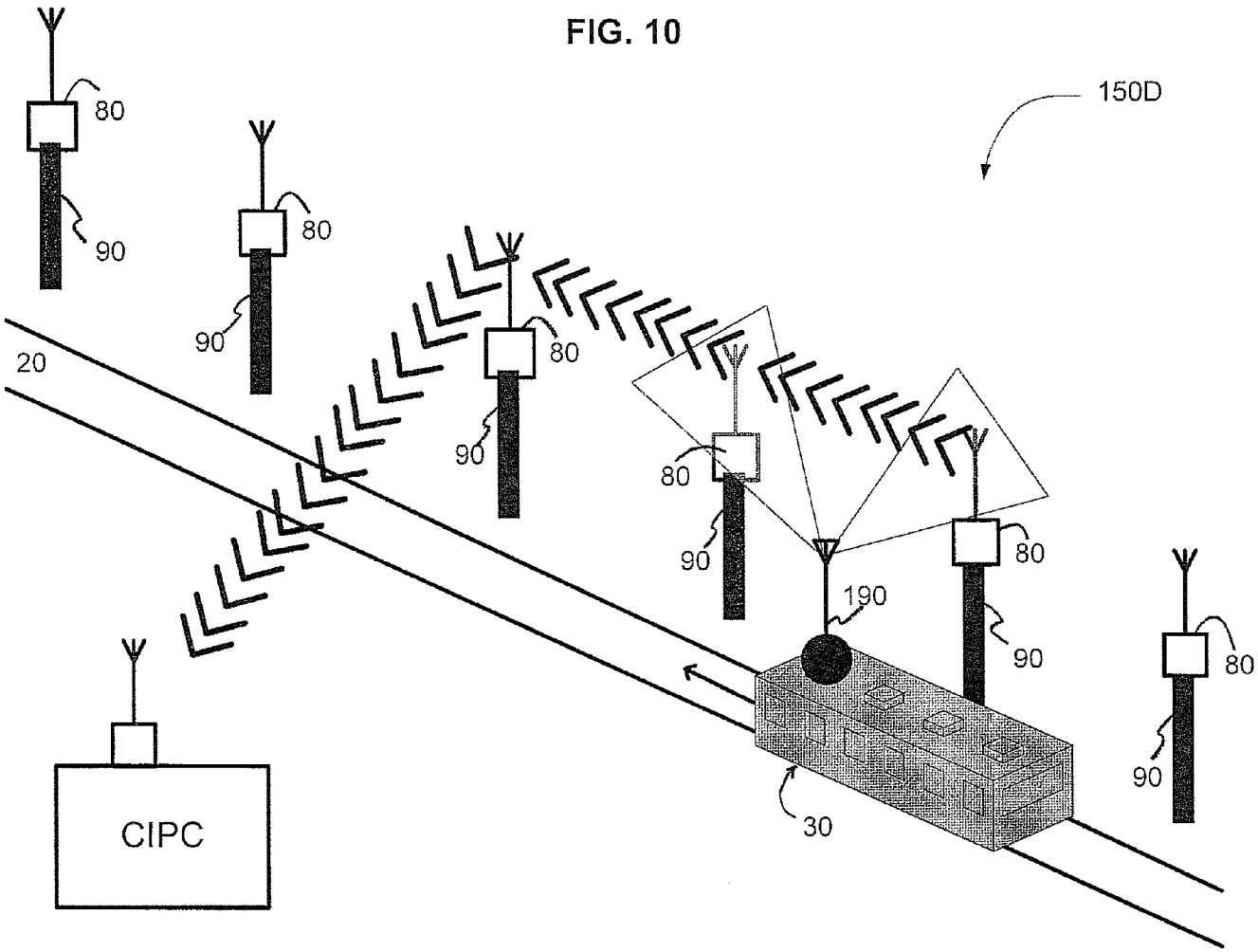
FIG. 10 is an illustration of an embodiment of the safety system wherein the rail vehicle communicates wirelessly to the CIPC.

In accordance with a different embodiment as illustrated by FIG. 10, the safety system 150D includes a setup that is quite similar to the operation as described earlier and illustrated in FIG. 4 where the communication between the rail vehicle 30, the transceivers 80 and the CIPC 50 may also be wireless, using a communication mode such as WIMAX or ZIGBEE.

Figure 11:
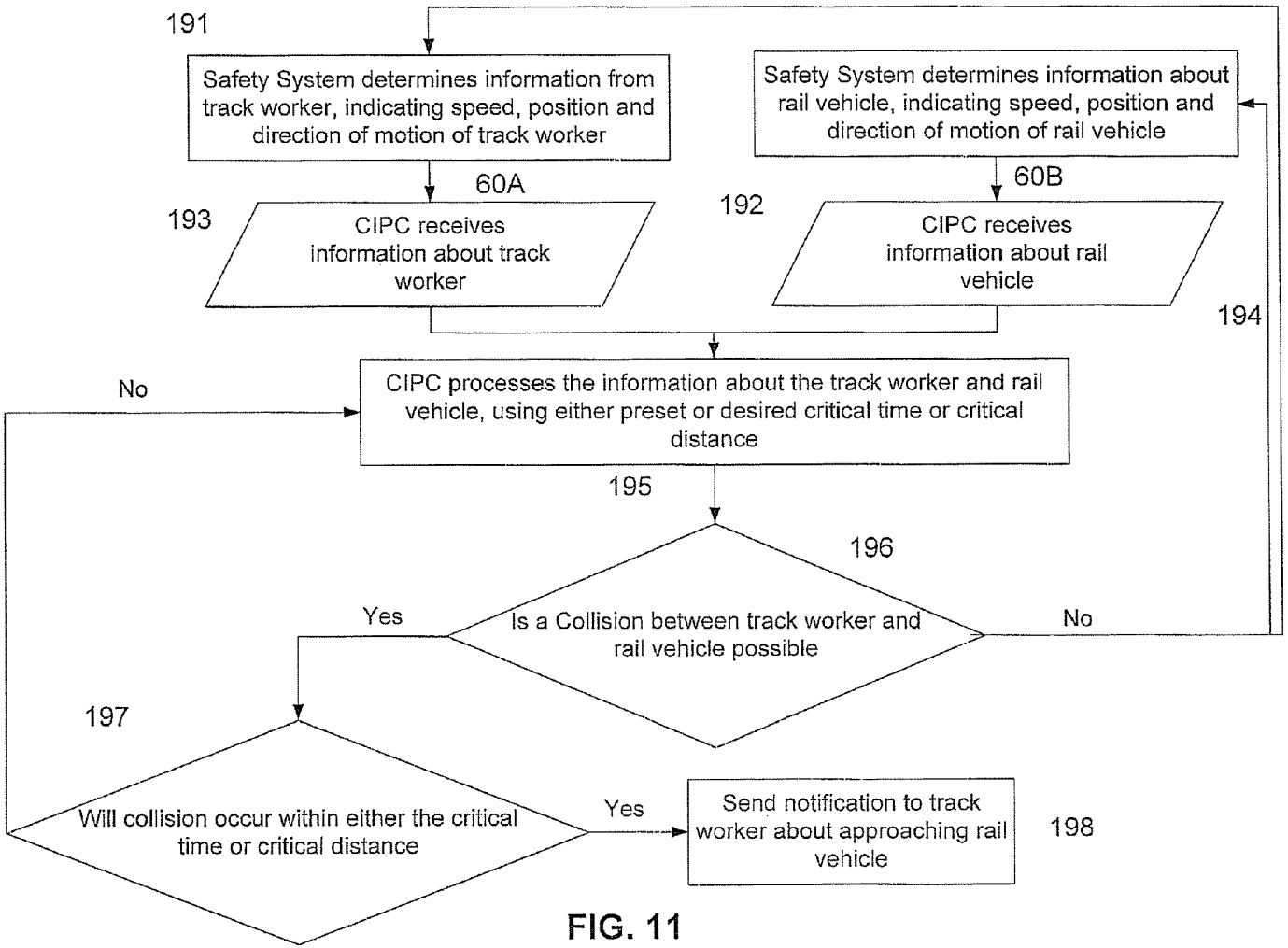
FIG. 11 is a flow chart illustrating an exemplary method of sending safety alarm notifications to the authorized track worker.

In the previous sections, it was described in detail about how the safety system obtains and/or determines information from the track worker 40 and the rail vehicle 30 that indicate the speed, location and direction of motion of the track worker 40 and rail vehicle 30 respectively. An exemplary method of sending a safety alarm notification to the track worker 40 is illustrated in FIG. 11. The method starts with the steps 191 and 192 of the safety system determining information 60A and 60B about the track worker 40 and the rail vehicle 30 respectively. It must be understood that the steps 191 and 192 may occur in series or in parallel. It also does not matter which step occurs first. At steps 193 and 194, the CIPC 50 receives the respectively information from the track worker 40 and the rail vehicle 30. At step 195, the CIPC 50 processes the information 60A and 60B along with the critical time or the critical distance indication provided by either the system or by the track worker or a supervisor. At step 196, the CIPC determines if a collision is even possible between the track worker 40 and the rail vehicle 30. If the collision is impending, the CIPC 50 determines at step 197 whether or not the collision will occur within the critical time or critical distance. Again, if the determination is affirmative, the CIPC 50 sends in a notification to the track worker about the impending collision. In an alternate embodiment where at step 196, the collision is not determined to occur, the safety system continues to obtain information about the track worker 40 and any rail vehicle on the rail network for any future occurrence of collision. Further, in another alternate embodiment where at step 197, the CIPC 50 determines that the collision is not going to occur within the critical time or critical distance, the CIPC will continue to monitor the movement of the track worker 40 and the rail vehicle 30 until the time to collision or distance to collision is within the critical time or critical distance respectively.

Figure 12:
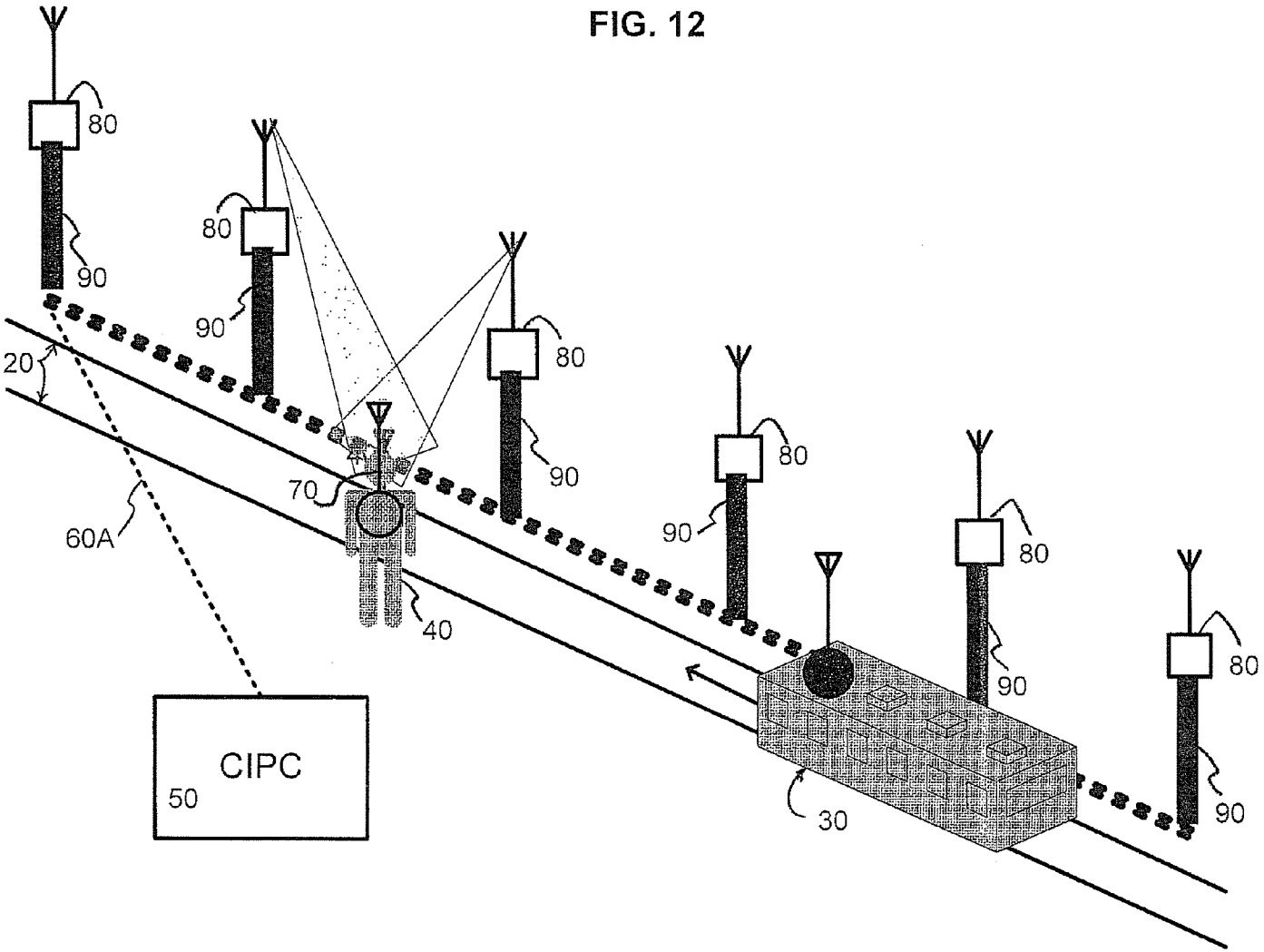
FIG. 12 is an illustration of one embodiment of the safety system showing how notifications are sent from the CIPC to the track worker using a wired CNB of FIG. 2.
Figure 13:
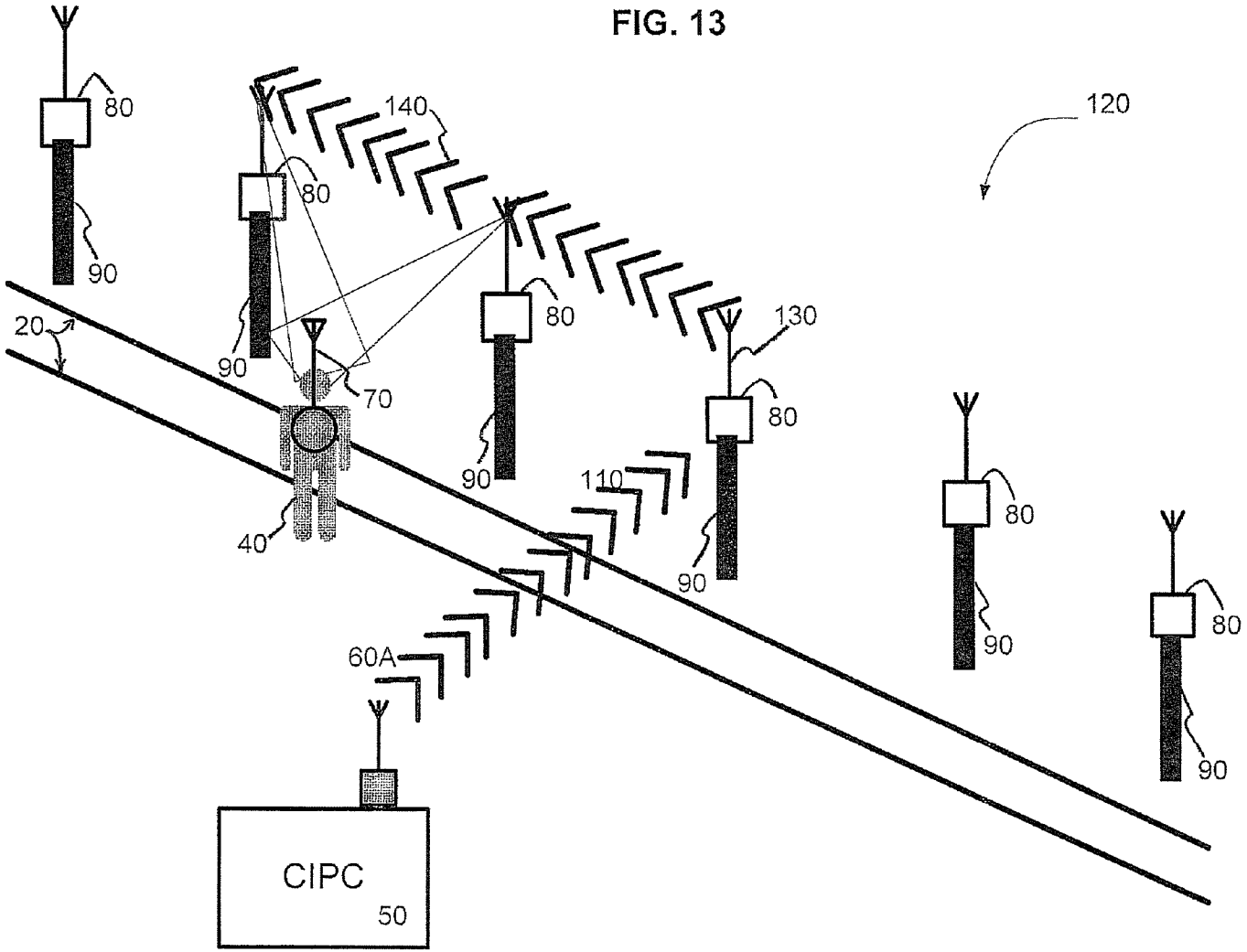
FIG. 13 is an illustration of another embodiment of the safety system showing how the notifications are sent from the CIPC to the track worker using the wireless CNB of FIG. 4.

The following sections describe how an alarm notification may be sent by the CIPC 50 to the track worker 40. In one embodiment as shown in FIG. 12, the alarm notification 200 can be issued either using the same infrastructure as discussed in FIG. 2. Alternately, as shown in FIG. 13, the alarm notification 200 can be sent via wireless using the same infrastructure as discussed in FIG. 4. FIGS. 12 and 11 are quite identical in physical setup as FIGS. 2 and 3 respectively; however, the difference in functionality is the direction of flow of information.

Figure 14:
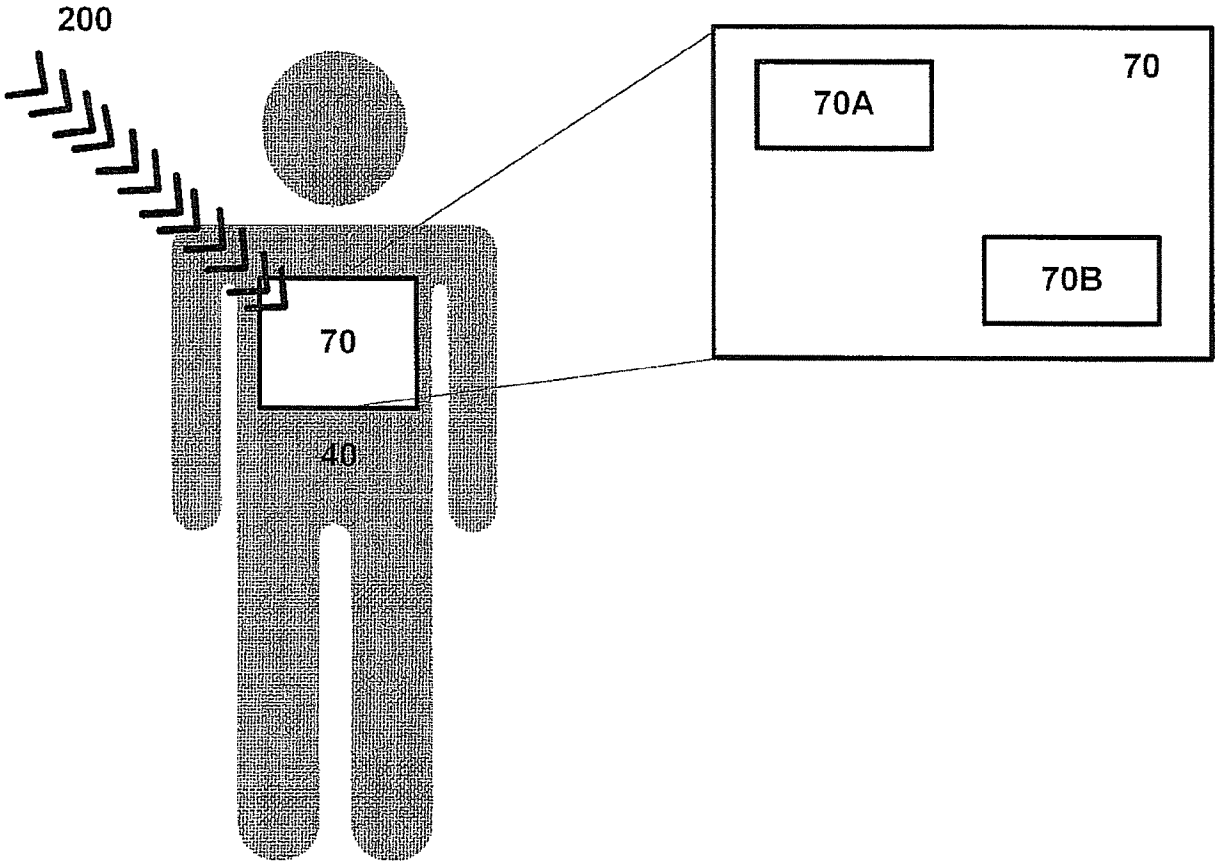
FIG. 14 is an illustration of an exemplary track worker comprising of the device 70 that includes an alarm notifier and an RFID tag.

In one embodiment, as shown in FIG. 14, an alarm notification may be sent through the transceivers 80 back to the device 70 on the track worker 40. The device 70, apart from the RFID tag 70A, may also include an alarm notifier (70B) that will provide an audible or a visual or a mechanical signal. Upon receiving the notification, the track worker 40 is obligated to be aware of the danger and take evasive actions that will move the track worker, and any fellow colleagues and/or equipment. This will prove to be beneficial to both the track worker 70, and to the approaching rail vehicle 30. In another embodiment, the alarm notifier 70B may be adapted to provide notification that indicates an urgency as the estimated danger gets closer to occurrence. For example, the number of beeps that the alarm notifier 70B emits may be 10 beeps a minute when the danger is more than five minutes from occurrence. The number of beeps may increase to 15 beeps per minute when the danger is more than 2 minutes from occurrence. During the final minute to estimated occurrence, the alarm notifier 70B may emit 30 beeps per minute. It must further be noted that the number of beeps emitted by the alarm notifier 70B may be controlled by the CIPC 50 based on the estimations made by the CIPC 50.

Figure 15:
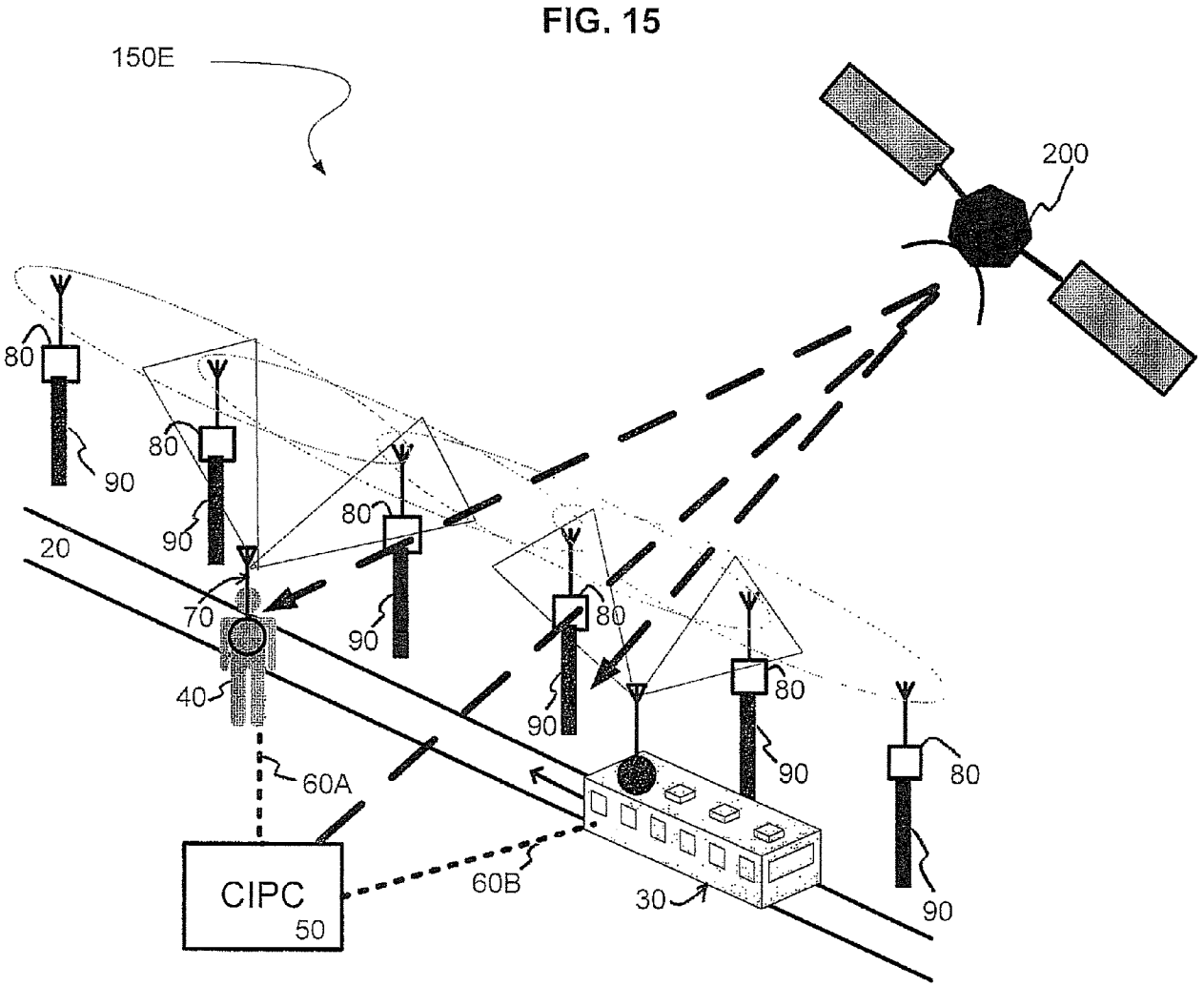
FIG. 15 is an illustration of another embodiment of the safety system where position location of the track worker and the rail vehicle is obtained using satellite based positioning systems.

FIG. 15 illustrates another embodiment of the safety system 150E where the capability of the proposed system is further enhanced by using satellite navigation techniques such as a global positioning system or GPS. In this embodiment, there are at least three satellites, such as the satellite 200. The GPS technique uses known methods such as triangulation and other similar methods to accurately determine whether or not a track worker is in the path of the approaching rail vehicle 30. The CIPC 50 may be directly configured to receive the position information from the GPS system to determine track worker 40 and/or rail vehicle information 60A and 60B such as speed, position and direction of movement respectively. It is also possible in another embodiment to use a public regulated service such as envisioned by European Space Agency's Galileo global navigation satellite system.

Figure 16:
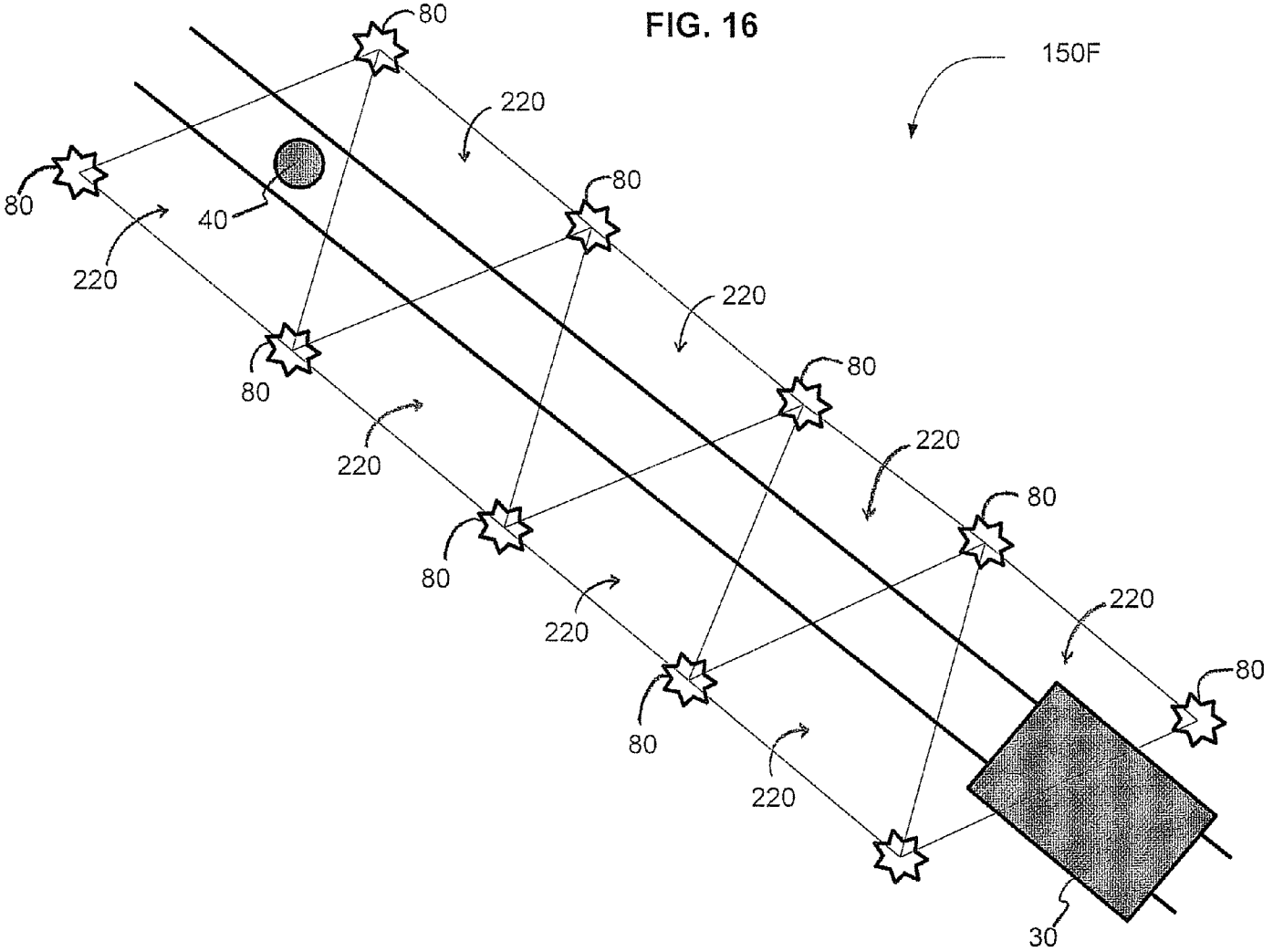
FIG. 16 is an illustration of another embodiment of the safety system showing a non-linear arrangement of transceivers along a rail road.

FIG. 16 illustrates another embodiment of the safety system 150F where a different arrangement of transceivers 80 is seen. In this particular arrangement, each of the triangular areas 220 is covered by the three nearest transceivers. This ensures that any track worker 40 within the area between the two separate rows of transceivers on either side of the railroad 20 will be monitored by three transceivers 80. It will be appreciated by a person skilled in the art that such monitoring provides a way of more, accurately determining the position of the track worker 40 using methods such as triangulation or trilateration. The rail vehicle 30 will further be read by any three transceivers 80 at any point in time. This allows for the accurate determination of rail vehicle speed, location and direction of movement.

Figure 17:
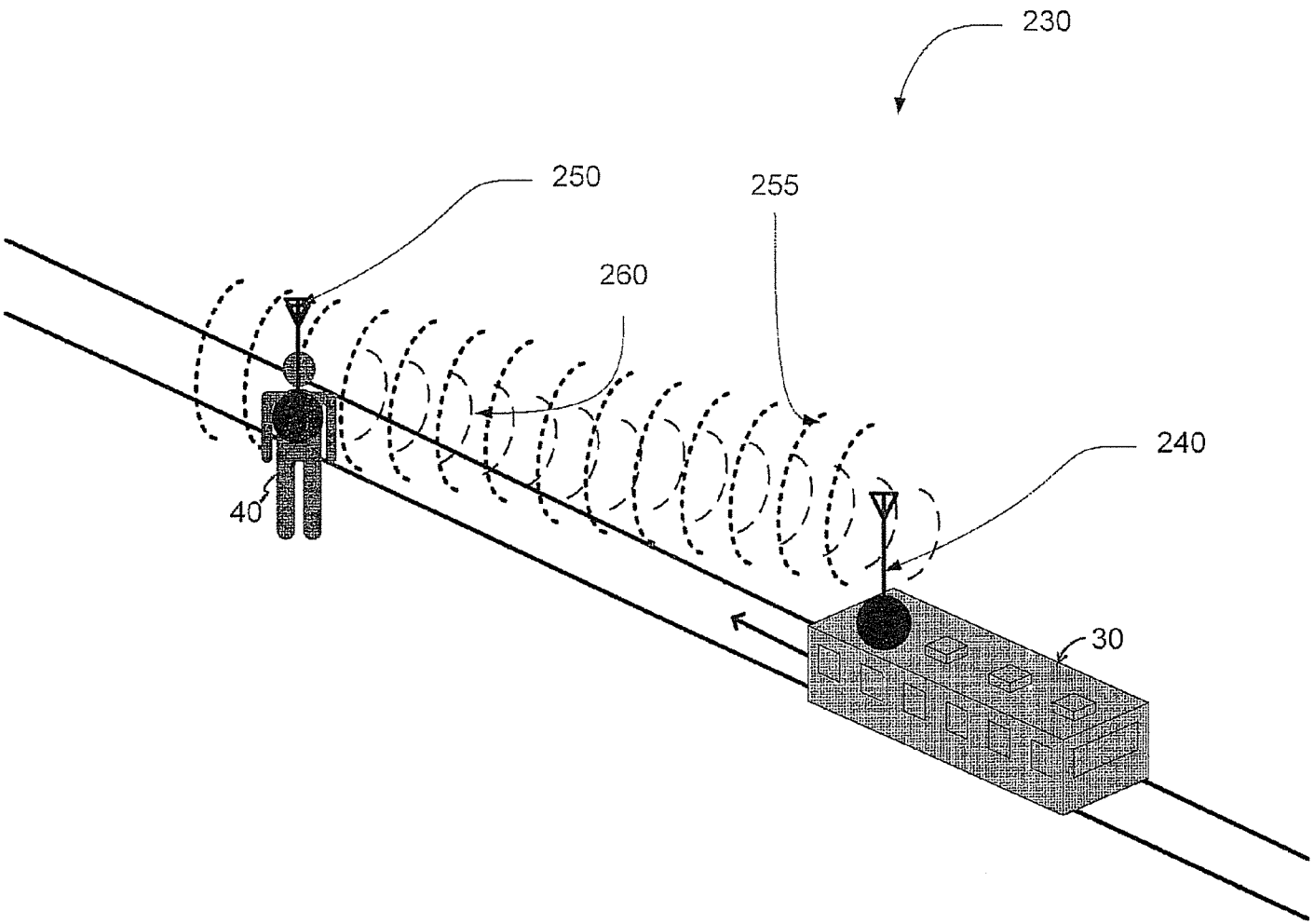
FIG. 17 is an illustration of interaction between the track worker and a stand-alone warning system present on the approaching rail vehicle.

FIG. 17 illustrates an embodiment of a standalone warning system 230 that may be used as a last resort in case of any unexpected malfunction or non-working of any other safety mechanism as detailed previously. This standalone warning system 230 includes an UWB RFID reader 240 located on the rail vehicle 30, and a UWB RFID transmitter 250 located on the track worker 40. The UWB RFID reader 240 constantly scans the area ahead of the rail vehicle 30 by emitting RFID signals 255. In the track worker 40 wears an RED device that is passive in nature, then the RFID device would first energize using the received RFID signals 255 and then transmit RFID signals 250 to the rail vehicle 30. In another embodiment, when the track worker wears an RFID device that is active, the RFID device emits RFID signals 250 on its own without any need for RFID signals 255 sent from the rail vehicle 30. It must be noted that the use of active RFID devices increases the range of detection when compared to a passive RFID system. In the illustrated scenario of FIG. 17, where there is a track worker 40 present in the path of the rail vehicle 30, the device 70 worn by the track worker 40 transmits UWB RFID signals 260 that are detected by the rail vehicle through the UWB RFID reader 240. A standalone processing unit (not shown) on the rail vehicle 30 determines from the read UWB RFD signals whether the signals are emitted from an authorized device worn on the track worker 40 or not, and if so, raises an alarm notification to the operator of the rail vehicle that a track worker 40 could potentially be on the path of the rail vehicle. The operator may choose to take emergency action, such as deployment of emergency brakes, to avoid colliding with the detected track worker 40.

Figure 18:
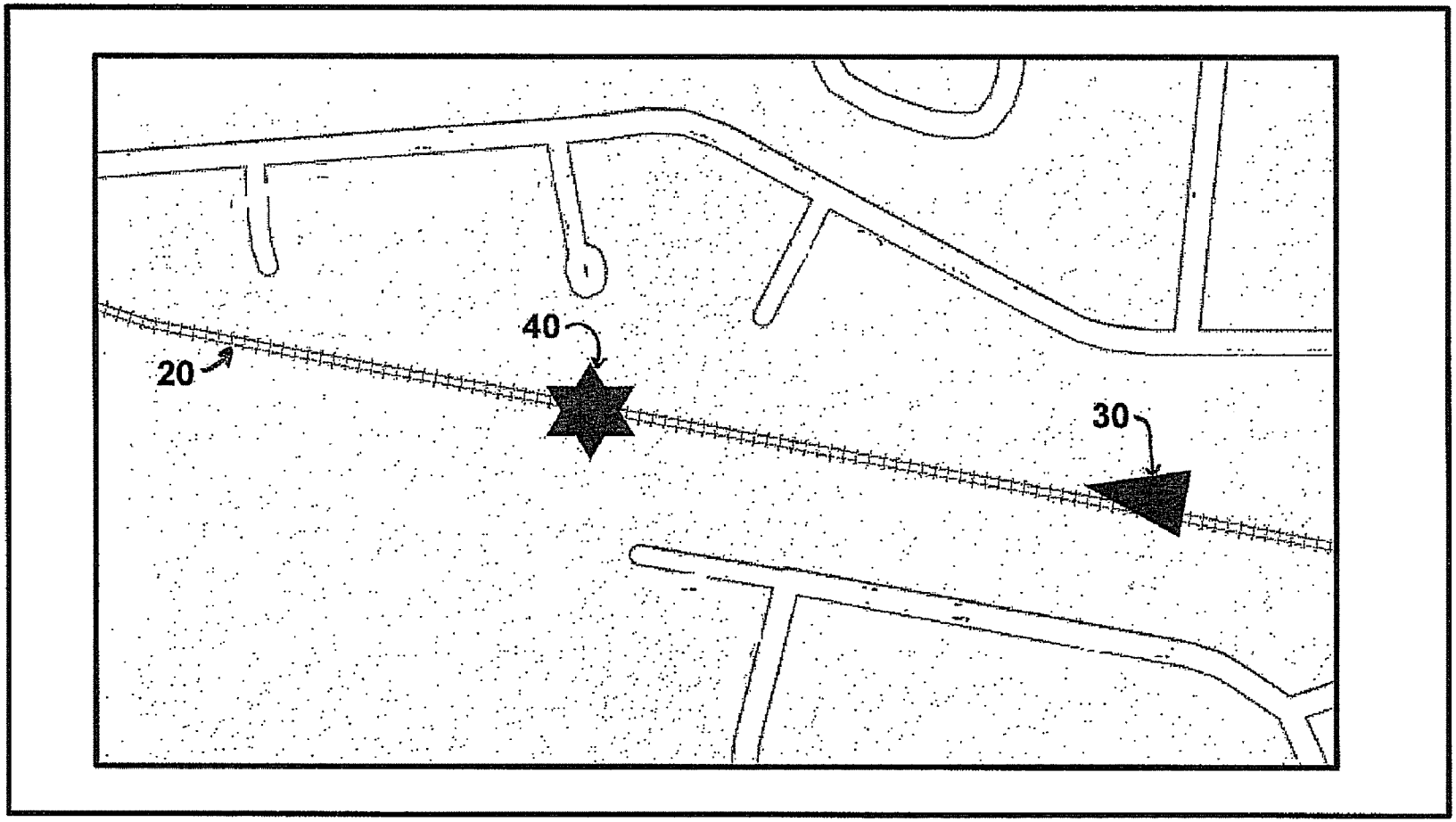
FIG. 18 is an illustration of an exemplary visual notification on a hand-held device held by the track worker showing relative position of the track worker and an approaching rail vehicle.

In accordance with another aspect of the invention, the track worker 40 may additionally be provided with a mobile safety device having a display as shown in FIG. 18. This device may be worn by the track worker or be a handheld device. The mobile safety device integrates a global positioning system (GPS), map of the rail network including a visual representation of the different rail roads and/or roads present in the vicinity along with train route maps including direction of travel of each rail vehicle. This mobile safety device may be in constant communication with the CIPC and/or the central control (not presently shown) where applicable. The advantage of such a device is that a track worker 40 carrying the mobile device will immediately know in real time when an alarm is received, which of the present rail roads are possible paths for approaching rail vehicles. In scenarios where a single rail road is present (as shown in FIG. 17), it is quite obvious, but in scenarios where there are multiple rail roads, and rail vehicles could be approaching from any direction, this feature would enable the track worker 40 to know which direction a rail vehicle is approaching and in which rail road. In a multiple rail road area, the rail road on which an approaching rail vehicle will travel may be shown in a particular color, example red, and adjacent rail roads where there will be no rail vehicle traveling may be shown in a different color, example green. By visual depiction of safe and unsafe rail roads, the mobile device facilitates an easy understanding from the track worker 40 and moves the track worker 40 to a point of safety. In order to use the mobile safety device, a first warning alerts a worker a train is in their safety zone. The worker can then view the mobile device for further information regarding all safety information.

In an alternate embodiment (not shown), the safety system 10 may also incorporate a system of embedded high intensity light emitting diodes (HILEDs) embedded between the parallel rails of the rail road, for instance embedded within the cross-ties that fasten the parallel rails. The array of HILEDs will be networked, with their own switching units to control when the HILEDs turn ON or turn OFF. In this embodiment the HILEDs are controlled and activated by the CIPC 50 will illuminate when a rail vehicle is within the critical distance or critical time. This will visually alert the track worker and enable a quick and easy way of moving to a point of safety. The HILEDs may optionally also be color coded to indicate an approaching danger. For example, when the danger is imminent, the HILEDs may flash with a different color. Naturally, such color coded HILEDs should be designed so as to not interfere with the rail vehicle operator in a manner that causes confusion between the color coded signaling lights typically found along the rail network.

In accordance with another aspect of the present invention, the CIPC 50 includes knowledge management software to achieve one or more of the features described hereinabove. The knowledge management software may include any commercially available real-time location awareness platform or architecture.

In accordance with another aspect of the present invention, the safety system 10 may be used to determine the localization of assets within the rail network 15. For example, equipment and/or personnel may be searched for within the rail network in the following manner. When a search is initiated to determine all the rail inspection vehicles on the network, and assuming that all rail inspection vehicles have been tagged with a radio transmitter and a receiver containing information about the rail inspection vehicles, the safety system 10 may be adapted to show on a full system map of the rail work where all the specific asset is located. The search for assets may not be limited to just equipment. It may be used to monitor the concentration of track workers in the entire rail network.

In accordance with yet another aspect of the present invention, the safety system 10 may be used to indicate violation of access by detecting the unauthorized presence track workers in specially designated areas. For example, a rail system administrator monitoring the rail network may quickly realize the presence of track workers in a wrong area of the rail network. For example, track replacement activities may be carried out on an unauthorized portion of the rail network due to a miscommunication. This, when properly detected, may reduce the amount of wasted time and resources and may further reduce the danger to track workers, rail vehicles, and the travelling passengers.

The safety system 10 envisioned herein has a lot of advantages. The embodiments disclosed herein have associated pros and cons. It should be realized that not all embodiments will work for every situation. The combination of various embodiments, and features to a specific application will result in a safety system that is finely tuned to work for that application. Such modifications should be construed as being within the scope of the present application. Furthermore, the use of commercially available software architectures and software platforms to facilitate the safety system also make is open for integration with newer architectures and platforms when one becomes available. The use of a specific software platform and/or architecture should not be seen as a limiting feature of the disclosed invention.

The safety system 10 described in many embodied configurations hereinabove may need to have failsafe means to ensure that the failure of a single component in the safety system 10 does not compromise the safety of the track worker 40. The failsafe means may require more than one system to be employed in place to achieve the required redundancy. The safety system 10 therefore may include one or more embodiments described above, and/or may include additional safety systems either already present in with part of the rail network, or be specifically incorporated for the purpose. Furthermore, when the safety system 10 is deployed in a transportation network other than a rail network, any existing safety systems may be added. For example, the teachings of the present invention can be applied to the protection of workers from other types of mobile assets, especially as part of heavy equipment, such as trucks, ships, off-road vehicles, and airplanes. All resulting modifications should be construed as being within the scope of the present invention.

The invention is claimed as follows:

1. A safety system for providing notification to an authorized worker in the vicinity of a rail network about an approaching rail vehicle, the system comprising:

a worker identifier device adapted to continuously emit information contained within the worker identified device;

one or more receivers adapted to receive the information emitted by the worker identified device; and a processing unit in communication with one or more detectors to determine position of the authorized worker based on at least one of the information received from the worker identification device, information pertaining to the one or more detectors that received the information from the worker identifier device, and information about position of the rail vehicle, wherein the processing unit determines the rail vehicle's estimated time to impact the authorized worker based on one of critical time or critical distance.

2. The safety system of claim 1, wherein the processing unit is adapted to generate a notification to the worker identifier device about an approaching rail vehicle.

3. The safety system of claim 2, wherein the notification is relayed from the processing unit to the authorized worker using one or more transmitters.

4. The safety system of claim 3, wherein the one or more transmitters and the one or more receivers are integrated into one or more transceivers wherein each transceiver includes at least one transmitter and one receiver.

5. The safety system of claim 4, wherein each of the one or more transceivers are located at spatially distant from one another along the rail network.

6. The safety system of claim 5, wherein each of the one or more transceivers is in communication with the processing unit.

7. The safety system of claim 6, wherein each of the one or more transceivers are linked via a wired communications network backbone.

8. The safety system of claim 6, wherein each of the one or more transceivers are linked via a wireless network.

9. The safety system of claim 3, wherein the worker identifier device receives the notification from the processing unit about an approaching rail vehicle.

10. The safety system of claim 9, wherein the notification is in the form of at least one of an audible alarm, a physical sensation, and a visible alarm.

11. The safety system of claim 7, wherein the wired communications backbone is one of an optical backbone and an Ethernet-based backbone.

12. The safety system of claim 1, wherein the worker identifier device is associated with at least one of the authorized worker's helmet, clothing, wrist watch, safety equipment, or communications equipment.

13. The safety system of claim 1, wherein the processing unit communicates with an existing train control system within the rail network.

14. The safety system of claim 13, wherein the processing unit uses information from the existing train control system to determine the information about the position of the rail vehicle.

15. The safety system of claim 14, wherein the information from the existing train control system includes information about at least one of speed of the rail vehicle, direction of travel of the rail vehicle, and route of the rail vehicle.

16. The safety system of claim 1, further comprising a satellite based positioning system for accurately determining the position of the authorized worker and/or position of the rail vehicle.

17. The safety system of claim 1, further comprising a hand-held visual indicator for the authorized worker displaying the position of the authorized worker, layout of the rail network and the position of the rail vehicle.

18. The safety system of claim 17, wherein the hand-held visual indicator is updated in real-time to show changes in position of the authorized worker and/or the rail vehicle.

19. The safety system of claim 1, further comprising a vehicle-based early warning system, the vehicle-based early warning system comprising:

a radio-based interrogator unit adapted to communicate directly with the worker identifier device on the authorized worker; and a vehicle-based processing unit adapted to alert a rail vehicle driver about presence of the authorized worker.

20. The safety system of claim 19, wherein the vehicle-based processing unit communicates with the processing unit.

21. The safety system of claim 1, further comprising a visual indicator system along the rail network controlled by the processing unit to provide a visual warning to the authorized worker about the approaching rail vehicle.

22. The safety system of claim 21, wherein the visual indicator system comprises a plurality of high intensity light emitting diodes (HILEDs).

23. The safety system of claim 21, wherein the plurality of HILEDs are embedded in a plurality of cross-ties used in the rail network.

24. The safety system of claim 23, wherein each of the cross-ties includes one or more HILEDs.

25. The safety system of claim 1, wherein one of the critical time and the critical distance is indicated by the authorized worker.

26. The safety system of claim 1, wherein the processing unit is adapted to accept an upper limit and a lower limit for at least one of the critical time and the critical distance.

27. The safety system of claim 26, wherein the upper limit and the lower limit is provided by one of the authorized worker or a rail network safety administrator.

28. The safety system of claim 1, wherein the worker identifier device is self-powered.

29. The safety system of claim 1, wherein the worker identifier device, the one or more detectors and the one or more receivers communicate using electromagnetic waves.

30. The safety system of claim 29, wherein wavelengths of the electromagnetic waves are within radio frequency spectrum.

31. The safety system of claim 1, wherein the worker identifier device, the one or more detectors and the one or more receivers operate on the principles of radio frequency identification.

32. The safety system of claim 31, wherein operating principle of the radio frequency identification is limited to ultra wide band radio frequency signal transmission modes.

* * * * *